US011355859B2

(12) United States Patent
Pelletti et al.

(10) Patent No.: US 11,355,859 B2
(45) Date of Patent: Jun. 7, 2022

(54) METAMATERTIAL, ANTENNA ARRAY HAVING AN APERTURE LAYER

(71) Applicant: Metawave Corporation, Palo Alto, CA (US)

(72) Inventors: Chiara Pelletti, San Francisco, CA (US); Maha Achour, Encinitas, CA (US)

( * ) Notice: Subject to any disclaimer, the term of this patent is extended or adjusted under 35 U.S.C. 154(b) by 223 days.

(21) Appl. No.: 16/439,616

(22) Filed: Jun. 12, 2019

(65) Prior Publication Data

US 2019/0379132 A1 Dec. 12, 2019

Related U.S. Application Data

(60) Provisional application No. 62/684,173, filed on Jun. 12, 2018.

(51) Int. Cl.

| | |
|---|---|
| ***H01Q 21/06*** | (2006.01) |
| ***H01Q 21/00*** | (2006.01) |
| ***H01Q 1/36*** | (2006.01) |

(52) U.S. Cl.

CPC ..... *H01Q 21/0025* (2013.01); *H01Q 1/36* (2013.01); *H01Q 21/0037* (2013.01); *H01Q 21/064* (2013.01)

(58) Field of Classification Search

CPC ..... H01Q 21/0037; H01Q 21/064

See application file for complete search history.

(56) References Cited

U.S. PATENT DOCUMENTS

| | | | |
|---|---|---|---|
| 6,492,949 | B1 | 12/2002 | Breglia et al. |
| 7,250,908 | B2 | 7/2007 | Lee |
| 8,633,866 | B2 | 1/2014 | Sarabandi et al. |

(Continued)

FOREIGN PATENT DOCUMENTS

CN 201336370 Y * 10/2009

OTHER PUBLICATIONS

M. Moeini-Fard, et al., "Transmit Array Antenna Using Nonuniform Dielectric Layer. Advances in Wireless Communications and Networks," vol. 3, No. 3, pp. 23-28, Jun. 2017.

(Continued)

*Primary Examiner* — Daniel Munoz

(74) *Attorney, Agent, or Firm* — Sandra Lynn Godsey

(57) ABSTRACT

The present disclosures provide methods and apparatuses for a metamaterial antenna structure having a plurality of super elements of slotted transmission lines. The metamaterial antenna structure has an aperture structure with apertures positioned in a specific orientation relative to a centerline of the aperture structure and configured to propagate transmission signals from a distributed feed network through the apertures. The metamaterial antenna structure also has a transmission array structure comprising a plurality of transmission lines coupled to the aperture structure and configured to propagate the transmission signals from the aperture structure through one or more slots in the transmission array structure, in which the apertures of the aperture structure are interposed between the slots. The metamaterial antenna structure also has a radiating array structure coupled to the transmission array structure and configured to radiate the transmission signals from the transmission array structure.

20 Claims, 16 Drawing Sheets

(56) References Cited

U.S. PATENT DOCUMENTS

| | | | | |
|---|---|---|---|---|
| 8,803,739 | B2 | 8/2014 | Rajgopal et al. | |
| 9,545,923 | B2 | 1/2017 | Casse et al. | |
| 10,186,787 | B1 * | 1/2019 | Wang | H01Q 13/10 |
| 2013/0120206 | A1 * | 5/2013 | Biancotto | H01P 11/00 343/776 |
| 2016/0011307 | A1 | 1/2016 | Casse et al. | |
| 2016/0013531 | A1 | 1/2016 | Casse et al. | |

OTHER PUBLICATIONS

A. Abbaspour-Tamijani, "Novel Components for Integrated Millimeter-Wave Front-Ends," Dissertation, pp. 1-163, University of Michigan, Ann Arbor, United States, 2004.

X. Gu et al., "A multilayer organic package with 64 dual-polarized antennas for28GHz 5G communication," 2017 IEEE Mtt-S International Microwave Symposium (IMS), Honololu, HI, pp. 1899-1901, Jun. 2017.

L. Y. Ji et al., "A reconfigurable beam-scanning partially reflective surface (PRS) antenna," 2015 9th European Conference on Antennas and Propagation (EuCAP), Lisbon, pp. 1-3, Apr. 2015.

J. Yun, et al., "Dual TX/RX 8x4 sub-arrays for phased array antenna," Electronics and Telecommunications Research Institute (ETRI), Yusong, Korea, pp. 1-4, 2003.

M. Zhang, et al. "Design of a Double-Layer Slotted Waveguide Array with a Partially Corporate Feed Circuit Installed in the Bottom Layer and its Fabrication by Diffusion Bonding of Laminated Thin Plates in 38GHz Band," The2009 International Symposium on Antennas and Propagation (ISAP 200), pp. 373-376, Oct. 2009.

L. Boccia, et al., "Multilayer Antenna-Filter Antenna for Beam-Steering Transmit-Array Applications," IEEE Trans, on Microwave Theory and Techniques, vol. 60, No. 7, pp. 2287-2300, Jul. 2012.

A.H. Abdelrahman, et al., "Transmission Phase Limit of Multilayer Frequency-Selective Surfaces for Transmitarray Designs," IEEE Trans, on Antennas and Propagation, vol. 62, No. 2, pp. 690-697, Feb. 2014.

C. Tripon-Canseliet, et al., "Contribution of MetaMaterials to Improvement of Scan Performance and Reconfigurability of Phased Array Antennas," International Radar Conference, Lille, France, pp. 1-3, Oct. 2014.

C. G. M. Ryan, et al. "A Wideband Transmitarray Using Dual-Resonant Double Square Rings," in IEEE Transactions on Antennas and Propagation, vol. 58, No. 5, pp. 1486-1493, May 2010.

* cited by examiner

METAMATERTIAL, ANTENNA ARRAY HAVING AN APERTURE LAYER

CROSS-REFERENCE TO RELATED APPLICATIONS

This application claims priority from U.S. Provisional Application No. 62/684,173, filed on Jun. 12, 2018, and incorporated by reference in its entirety.

BACKGROUND

In a wireless transmission system, such as radar or cellular communications, the size of the antenna is determined by the transmission characteristics. With the widespread application of wireless applications, the footprint and other parameters allocated for a given antenna, or radiating structure, are constrained. In addition, the demands on the capabilities of the antenna continue to increase, such as, among others, increased bandwidth, finer control, and increased range.

BRIEF DESCRIPTION OF THE DRAWINGS

The present application may be more fully appreciated in connection with the following detailed description taken in conjunction with the accompanying drawings, which are not drawn to scale and in which like reference characters refer to like parts throughout, and wherein.

DETAILED DESCRIPTION

Figure 1:
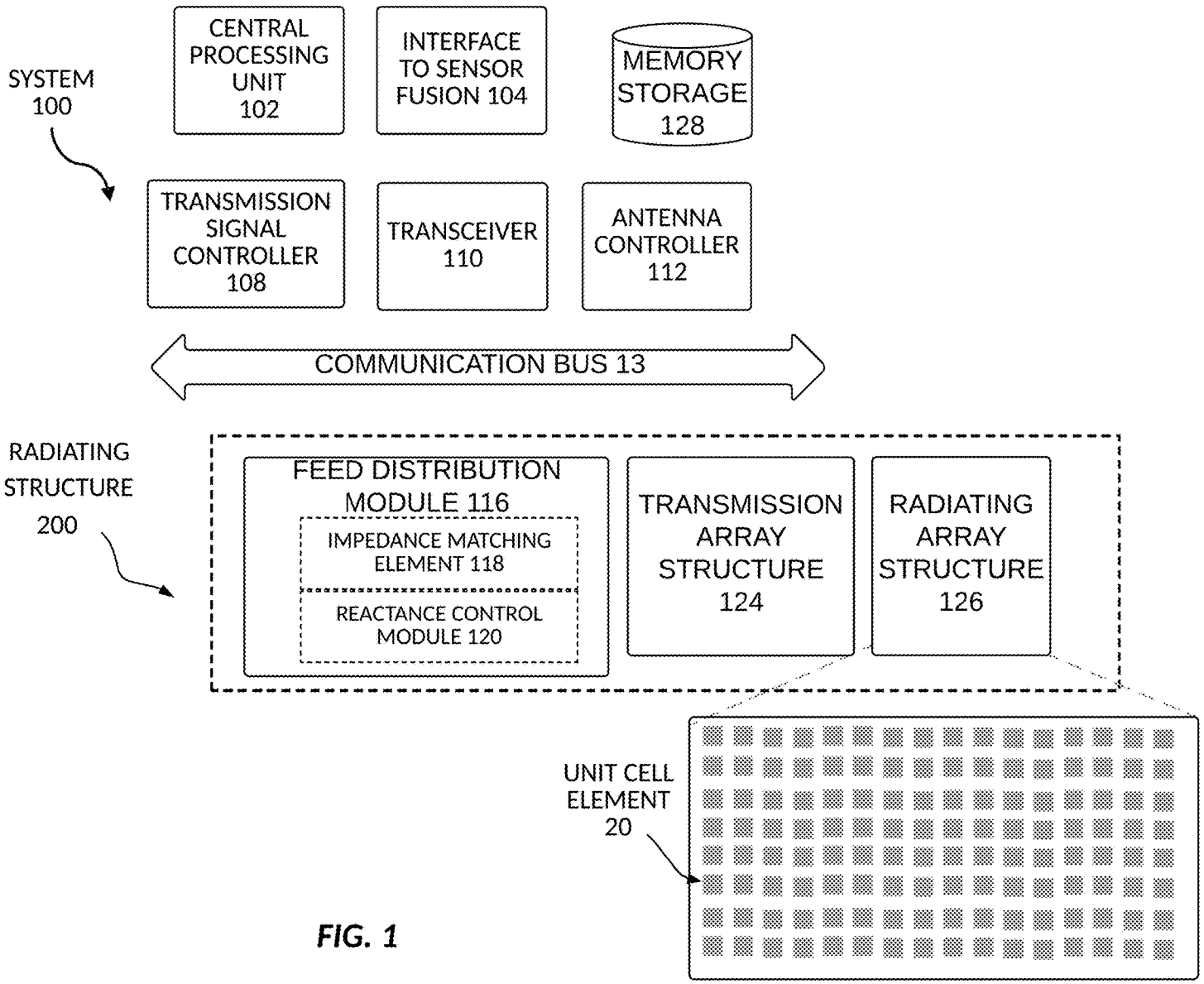
FIG. 1 illustrates an antenna system, according to implementations of the subject technology.

The present disclosure provides methods and apparatuses for radiating a signal, such as for radar or wireless communications, using a lattice array of radiating elements, a transmission array and a feed structure. The feed structure distributes a transmission signal throughout the transmission array, in which the transmission signal propagates along the rows of the transmission array and discontinuities are positioned along each row. This portion of the transmission array structure is a radiating portion of super elements that feed transmission signals to a lattice array of radiating elements, such as, for example, meta-structure unit cells. Within the super elements, the discontinuities (or slots) are positioned to correspond to radiating elements of the lattice array. In this way, there are multiple layers of radiating elements, including the super element layer and the meta-structure layer(s).

The radiating elements are coupled to an antenna controller that applies voltages to the radiating elements to change their electromagnetic characteristics. This change may be an effective change in capacitance that acts to shift the phase of the transmission signal. By phase shifting the signal from individual radiating elements, the system forms a specific beam in a specific direction. The various slot configurations achieve different results and may be used with specific frequency bands. Some of these configurations may be used in combination with each other, such as to have one configuration of super elements for identifying one type of object and a second configuration of super elements for identifying a second type of object. In some implementations, the multiple configurations of super elements are presented in a layer within an antenna system and operate according to circuitry designed to optimize object identification in a radar system.

The present disclosure also provides a construction of multiple layers acting as a feed to a radiating layer. Transmission signals are provided from a power divider circuit as Substrate Integrated Waveguides (SIWs), in which the transmission signals first propagate through an aperture layer that is an SIW having apertures positioned within the layer. The apertures are formed by large slots in the aperture layer. These apertures are positioned to correlate to a layer of transmission lines having slots configured along the length of the transmission lines. This second layer is proximate to the aperture layer; however, the second layer is not directly coupled to the power divider circuit or distributed feed network. The radiating layer is proximate to the second layer, or to the super element layer. The transmission signals propagating through the super elements in the super element layer are radiated to the radiating layer through the slots on the super element layer. The aperture layer distributes the transmission signal in a manner that reduces the distortions of radiated signals, such as squint.

The transmission array and radiating layers may be fed from multiple sides, such as orthogonal feed distribution networks. In this way, beam steering is supported in multiple dimensions. There may also be additional aperture layers for a multi-layer stack, in which the transmission signals may be fed into one or more layers in a variety of methods.

In some implementations, a radar system steers a highly-directive Radio Frequency (RF) beam that can accurately determine the location and speed of road objects. The subject technology is not prohibited by weather conditions or clutter in an environment. The subject technology uses radar to provide information for two-dimensional (2D) image capability as they measure range and azimuth angle, providing distance to an object and azimuth angle identifying a projected location on a horizontal plane, respectively, without the use of traditional large antenna elements.

The subject technology is applicable in wireless communication and radar applications, and in particular those incorporating meta-structures capable of manipulating electromagnetic waves using engineered radiating structures. A meta-structure, as generally defined herein, is an engineered, non- or semi-periodic structure that is spatially distributed to meet a specific phase and frequency distribution. In some implementations, the meta-structures include metamaterials (MTMs). For example, the present disclosure provides for antenna structures having MTM elements and arrays. There are structures and configurations within a feed network to the metamaterial elements that increase performance of the antenna structures in many applications, including vehicular radar modules. Additionally, the present disclosures provide methods and apparatuses for generating wireless signals, such as radar signals, having improved directivity, reduced undesired radiation patterns aspects, such as side lobes. The present disclosures provide antennas with unprecedented capability of generating RF waves for radar systems. These disclosures provide improved sensor capability and support autonomous driving by providing one of the sensors used for object detection. The disclosures are not limited to these applications and may be readily employed in other antenna applications, such as wireless communications, 5G cellular, fixed wireless and so forth.

The subject technology relates to smart active antennas with unprecedented capability of manipulating RF waves to scan an entire environment in a fraction of the time of current systems. The subject technology also relates to smart beam steering and beam forming using MTM radiating structures in a variety of configurations, in which electrical changes to the antenna are used to achieve phase shifting and adjustment reducing the complexity and processing time and enabling fast scans of up to approximately 360° field of view for long range object detection.

The present disclosure provides for methods and apparatuses for radiating structures, such as for radar and cellular antennas, and provide enhanced phase shifting of the transmitted signal to achieve transmission in the autonomous vehicle communication and detection spectrum, which in the US is approximately 77 GHz and has a 5 GHz range, specifically, 76 GHz to 81 GHz, to reduce the computational complexity of the system, and to increase the transmission speed. The present disclosure accomplishes these goals by taking advantage of the properties of hexagonal structures coupled with novel feed structures. In some implementations, the present disclosure accomplishes these goals by taking advantage of the properties of MTM structures coupled with novel feed structures.

Metamaterials derive their unusual properties from structure rather than composition and they possess exotic properties not usually found in nature. The metamaterials are structures engineered to have properties not found in nature. The metamaterial antennas may take any of a variety of forms, some of which are described herein for comprehension; however, this is not an exhaustive compilation of the possible implementations of the present disclosure. Metamaterials are typically arranged in repeating patterns. For antennas, metamaterials may be built at scales much smaller than the wavelengths of transmission signals radiated by the metamaterial. Metamaterial properties come from the engineered and designed structures rather than from the base material forming the structures. Precise shape, dimensions, geometry, size, orientation, arrangement and so forth result in the smart properties capable of manipulating EM waves by blocking, absorbing, enhancing, or bending waves.

The subject technology supports autonomous driving with improved sensor performance, all-weather/all-condition detection, advanced decision-making algorithms and interaction with other sensors through sensor fusion. These configurations optimize the use of radar sensors, as radar is not inhibited by weather conditions in many applications, such as for self-driving cars. The ability to capture environmental information early aids control of a vehicle, allowing anticipation of hazards and changing conditions. The sensor performance is also enhanced with these structures, enabling long-range and short-range visibility to the controller. In an automotive application, short-range is considered within 30 meters of a vehicle, such as to detect a person in a cross walk directly in front of the vehicle; and long-range is considered to be 250 meters or more, such as to detect approaching cars on a highway. The present disclosure provides for automotive radar sensors capable of reconstructing the world around them and are effectively a radar "digital eye," having true 3D vision and capable of human-like interpretation of the world.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, the subject technology is not limited to the specific details set forth herein and may be practiced using one or more implementations. In one or more instances, structures and components are shown in block diagram form in order to avoid obscuring the concepts of the subject technology.

The present disclosure is described in the context of an antenna system 100, conceptually illustrated in FIG. 1, for a vehicular application. This example is not meant to be limiting, but rather to provide a full example of the application of the present disclosure. The present disclosure describes the flexibility and robust design of the subject technology in antenna and radar design. The concepts described herein are also applicable to other systems and other antenna structures. The disclosure presented herein, along with variations thereof, may be used in communication systems or other applications that incorporate radiating elements and feed structures.

The antenna system 100 includes a central processing unit 102, an interface-to-sensor fusion 104, a transmission signal controller 108, a transceiver 110, an antenna controller 112, and a memory storage unit 128. The antenna system 100 is communicably coupled to a radiating structure 200 through a communication bus 13. The radiating structure 200 includes a feed distribution module 116, a transmission array structure 124, and a radiating array structure 126. The feed distribution module 116 includes an impedance matching element 118 and a Reactance Control Module (RCM) 120. Not all of the depicted components may be used, however, and one or more implementations may include additional components not shown in the figure. Variations in the arrangement and type of the components may be made without departing from the scope of the claims set forth herein. Additional components, different components, or fewer components may be provided.

As in FIG. 1, the antenna system 100 includes interfaces with other modules, such as through the interface-to-sensor fusion 104, where information is communicated between the antenna system 100 and a sensor fusion module (not shown). The antenna controller 112 can control the generation and reception of electromagnetic radiation, or energy beams. The antenna controller 112 determines the direction, power and other parameters of the beams and controls the radiating structure 200 to achieve beam steering in various directions. The antenna system 100 also includes modules for control of reactance, phase and signal strength in a transmission line.

The present disclosure is described with respect to a radar system, where the radiating structure 200 is a structure having a feed structure, such as the feed distribution module 116, with an array of transmission lines feeding a radiating array, such as the radiating array structure 126, through the transmission array structure 124. In some implementations, the transmission array structure 124 includes a plurality of transmission lines configured with discontinuities within the conductive material and the radiating structure 126 is a lattice structure of unit cell radiating elements proximate the transmission lines. The feed distribution module 116 may include a coupling module for providing an input signal to the transmission lines, or a portion of the transmission lines. In some implementations, the coupling module is a power divider circuit that divides the input signal among the plurality of transmission lines, in which the power may be distributed equally among the N transmission lines or may be distributed according to another scheme, such that the N transmission lines do not all receive a same signal strength.

In one or more implementations, the feed distribution module 116 incorporates a dielectric substrate to form a transmission path, such as a SIW. In this respect, the RCM 120 in the feed distribution module 116 may provide reactance control through integration with the transmission line, such as by insertion of a microstrip or strip line portion that couples to the RCM 120. The RCM 120 enables control of the reactance of a fixed geometric transmission line. In some implementations, one or more reactance control mechanisms (e.g., RCM 120) may be placed within a transmission line. Similarly, the RCM 120 may be placed within multiple transmission lines to achieve a desired result. The RCM 120 may have individual controls or may have a common control. In some implementations, a modification to a first reactance control mechanism is a function of a modification to a second reactance control mechanism.

In some implementations, the radiating structure 200 includes the power divider circuit and a control circuit therefor. The control circuit includes the RCM 120, or reactance controller, such as a variable capacitor, to change the reactance of a transmission circuit and thereby control the characteristics of the signal propagating through the transmission line. The RCM 120 acts to change the phase of a signal radiated through individual antenna elements of the radiating array structure 126. Where there is such an interruption in the transmission line, a transition is made to maintain signal flow in the same direction. Similarly, the RCM 120 may utilize a control signal, such as a Direct Current (DC) bias line or other control means, to enable the antenna system 100 to control and adjust the reactance of the transmission line. In some implementations, the feed distribution module 116 includes one or more structures that isolate the control signal from the transmission signal. In the case of an antenna transmission structure, the RCM 120 may serve as the isolation structure to isolate DC control signal(s) from Alternating Current (AC) transmission signals.

The impedance matching element 118 is coupled to the transmission array structure 124. In some implementations, the impedance matching element 118 incorporates the RCM 120 to modify a capacitance of the radiating array structure 126. The impedance matching element 118 may be configured to match the input signal parameters with radiating elements, and therefore, there are a variety of configurations and locations for this element, which may include a plurality of components.

In one or more implementations, the impedance matching element 118 includes a directional coupler having an input port to each of the adjacent transmission lines. The adjacent transmission lines and the impedance matching element 118 form a super element, in which the adjacent transmission line pair has a specific phase difference, such as a 90-degree phase difference with respect to each other.

The transmission line may have various portions, in which a first portion receives an transmission signal as an input, such as from a coaxial cable or other supply structure, and the transmission signal traverses a substrate portion to divide the transmission signal through a corporate feed-style network resulting in multiple transmission lines that feed multiple super elements. Each super element includes a transmission line having a plurality of slots. The transmission signal radiates through these slots in the super elements of the transmission array structure 124 to the radiating array structure 126, which includes an array of MTM elements positioned proximate the super elements. In some implementations, the array of MTM elements is overlaid on the super elements, however, a variety of configurations may be implemented. The super elements effectively feed the transmission signal to the array of MTM elements, from which the transmission signal radiates. Control of the array of MTM elements results in a directed signal or beamform.

As described in the present disclosure, a reactance control mechanism (e.g., RCM 120) is incorporated to adjust the effective reactance of a transmission line and/or a radiating element fed by a transmission line. In some implementations, the RCM 120 includes a varactor that changes the phase of a signal. In other implementations, alternate control mechanisms are used. The RCM 120 may be, or include at least a portion of, a varactor diode having a bias voltage applied by a controller (not shown). The varactor diode may serve as a variable capacitor when a reverse bias voltage is applied. As used herein, the term "reverse bias voltage" is also referred to herein as "reactance control voltage" or "varactor voltage." The value of the reactance, which in this case is capacitance, is a function of the reverse bias voltage value. By changing the reactance control voltage, the capacitance of the varactor diode is changed over a given range of values. Alternate implementations may use alternate methods for changing the reactance, which may be electrically or mechanically controlled. In some implementations, the varactor diode also may be placed between conductive areas of a radiating element. With respect to the radiating element, changes in varactor voltage produce changes in the effective capacitance of the radiating element. The change in effective capacitance changes the behavior of the radiating element and in this way the varactor diode may be considered as a tuning element for the radiating elements in beam formation.

In some implementations, the radiating array structure 126 is coupled to the antenna controller 112, the central processing unit 102, and the transceiver 110. The transmission signal controller 108 generates the specific transmission signal, such as a Frequency Modulated Continuous Wave (FMCW) signal, which is used as for radar sensor applications as the transmitted signal is modulated in frequency, or phase. The FMCW transmitter signal enables radar to measure range to an object by measuring the phase differences in phase or frequency between the transmitted signal and the received signal, or reflected signal. Other modulation types may be incorporated according to the desired information and specifications of a system and application. Within FMCW formats, there are a variety of modulation patterns that may be used within FMCW, including sinusoidal, triangular, sawtooth, rectangular and so forth, each having advantages and purposes. For example, sawtooth modulation may be used for large distances to a target; a triangular modulation enables use of the Doppler frequency, and so forth. The received information is stored in the memory storage unit 128, in which the information structure may be determined by the type of transmission and modulation pattern. Other modulation schemes may be employed to achieve desired results. The transmission signal controller 108 may generate a cellular modulated signal, such as an Orthogonal Frequency Division Multiplexing (OFDM) signal. The transmission feed structure may be used in a variety of systems. In some systems, the transmission signal is provided to the antenna system 100 and the transmission signal controller 108 may act as an interface, translator or modulation controller, or otherwise as required for the transmission signal to propagate through a transmission line network of the feed distribution module 116.

Continuing with FIG. 1, the radiating structure 200 includes the radiating array structure 126, composed of individual radiating elements discussed herein. The radiating array structure 126 may take a variety of forms and is designed to operate in coordination with the transmission array structure 124, in which individual radiating elements, depicted as unit cell element 20, correspond to elements within the transmission array structure 124. As used herein, the "unit cell element" is referred to as an "MTM unit cell" or "MTM element," and these terms are used interchangeably throughout the present disclosure without departing from the scope of the subject technology. The MTM unit cells include a variety of conductive structures and patterns, such that a received transmission signal is radiated therefrom. The MTM unit cell may serve as an artificial material, meaning a material that is not naturally occurring. Each MTM unit cell has some unique properties. These properties include a negative permittivity and permeability resulting in a negative refractive index; these structures are commonly referred to as left-handed materials (LHM). The use of LHM enables behavior not achieved in classical structures and materials. The MTM array is a periodic arrangement of unit cells that are each smaller than the transmission wavelength. One implementation is illustrated in which the radiating array structure 126 is an 8×16 cell array, in which each of the unit cell elements 20 has a uniform size and shape; however, alternate and other implementations may incorporate different sizes, shapes, configurations and array sizes.

As seen in the present disclosure, interesting effects may be observed in propagation of electromagnetic waves, or transmission signals. Metamaterials can be used for several interesting devices in microwave and terahertz engineering such as antennas, sensors, matching networks, and reflectors, such as in telecommunications, automotive and vehicular, robotic, biomedical, satellite and other applications.

In the system 100 of FIG. 1, the impedance matching element 118 and the reactance control element 120 are implemented to improve performance, reduce signal losses and so forth. In some implementations, the RCM 120 includes a capacitance control mechanism controlled by the antenna controller 112 to control the phase of a transmission signal as it radiates from radiating array structure 126. In some implementations, the antenna controller 112 determines a voltage matrix to apply to the reactance control mechanisms within the RCM 120 to achieve a given phase shift or other antenna parameters. In some implementations, the radiating array structure 126 is adapted to transmit a directional beam without incorporating digital beam forming techniques, but rather through active control of the reactance parameters of the individual unit cell elements 20 that make up the radiating array structure 126.

In a radar implementation, the antenna controller 112 receives information from within the antenna system 100. As illustrated in FIG. 1, information is provided from the radiating structure 200 and from the interface-to-sensor fusion 104 to a sensor fusion module (not shown). This implementation depicts a vehicular control system, but is applicable in other fields and applications as well. In a vehicular control system, the sensor fusion module can receive information (digital and/or analog form) from multiple sensors and can interpret that information, making various inferences and initiating actions accordingly. One such action is to provide information to the antenna controller 112, in which that information may be the sensor information or may be an instruction to respond to sensor information. The sensor information may provide details of an object detected by one or more sensors, including the object's range, velocity, acceleration, and so forth. The sensor fusion module may detect an object at a location and instruct the antenna controller 112 to focus a beam on that location. The antenna controller 112 then responds by controlling the transmission beam through the reactance control module 120 and/or other control mechanisms for the radiating structure 200. The instruction from the antenna controller 112 acts to control generation of radiation beams, in which a radiation beam may be specified by antenna parameters such as beam width, transmit angle, transmit direction and so forth.

The transceiver 110 prepares a signal for transmission, such as a signal for a radar device, in which the signal is defined by modulation and frequency. The signal is received by each unit cell element 20 of the radiating array structure 126 and the phase of the radiating array structure 126 is adjusted by the antenna controller 112. In some implementations, transmission signals are received by a portion, or subarray, of the radiating array structure 126. The radiating array structure 126 may be applicable to many applications, including radar and cellular antennas. The subject technology considers an application in autonomous vehicles, such as an on-board sensor to detect objects in the environment of the vehicle. Alternate implementations may use the subject technology for wireless communications, medical equipment, sensing, monitoring, and so forth. Each application type incorporates designs and configurations of the elements, structures and modules described herein to accommodate their needs and goals.

In the antenna system 100, a signal is specified by the antenna controller 112, which may be in response to prior signals processed by an Artificial Intelligence (AI) module that is communicably coupled to the antenna system 100 over the communication bus 13. In other implementations, the signal may be provided from the interface-to-sensor fusion 104. In still other implementations, the signal may be based on program information from the memory storage unit 128. There are a variety of considerations to determine the beam formation, in which this information is provided to the antenna controller 112 to configure the various unit cell elements 20 of the radiating array structure 126. The transmission signal controller 108 generates the transmission signal and provides the transmission signal to the feed distribution module 116, which provides the signal to transmission array structure 124 and radiating array structure 126.

When the transmission signal is provided to the radiating structure 200, such as through a coaxial cable or other connector, the transmission signal propagates through the feed distribution module 116 to the transmission array structure 124 through which the transmission signal radiates to the radiating array structure 126 for transmission through the air. As depicted in FIG. 1, the transmission array structure 124 and the radiating array structure 126 are arranged side-by-side, however, the physical arrangement of the radiating array structure 126 relative to the transmission array structure 124 may be different depending on implementation.

The impedance matching element 118 and the reactance control module 120 may be positioned within the architecture of feed distribution module 116. In some implementations, or one or both may be external to the feed distribution module 116 for manufacture or composition as an antenna or radar module in other implementations. The impedance matching element 118 works in coordination with the reactance control module 120. The implementation illustrated in FIG. 1 enables phase shifting of radiating signals from radiating array structure 126. This enables a radar unit to scan a large area with the radiating array structure 126. For vehicle applications, sensors seek to scan the entire environment of the vehicle. These then may enable the vehicle to operate autonomously, or may provide driver assist functionality, including warnings and indicators to the driver, and controls to the vehicle. The subject technology in the present disclosure is a dramatic contrast to the traditional complex systems incorporating multiple antennas controlled by digital beam forming. The subject technology increases the speed and flexibility of conventional systems, while reducing the footprint and expanding performance.

Figure 2:
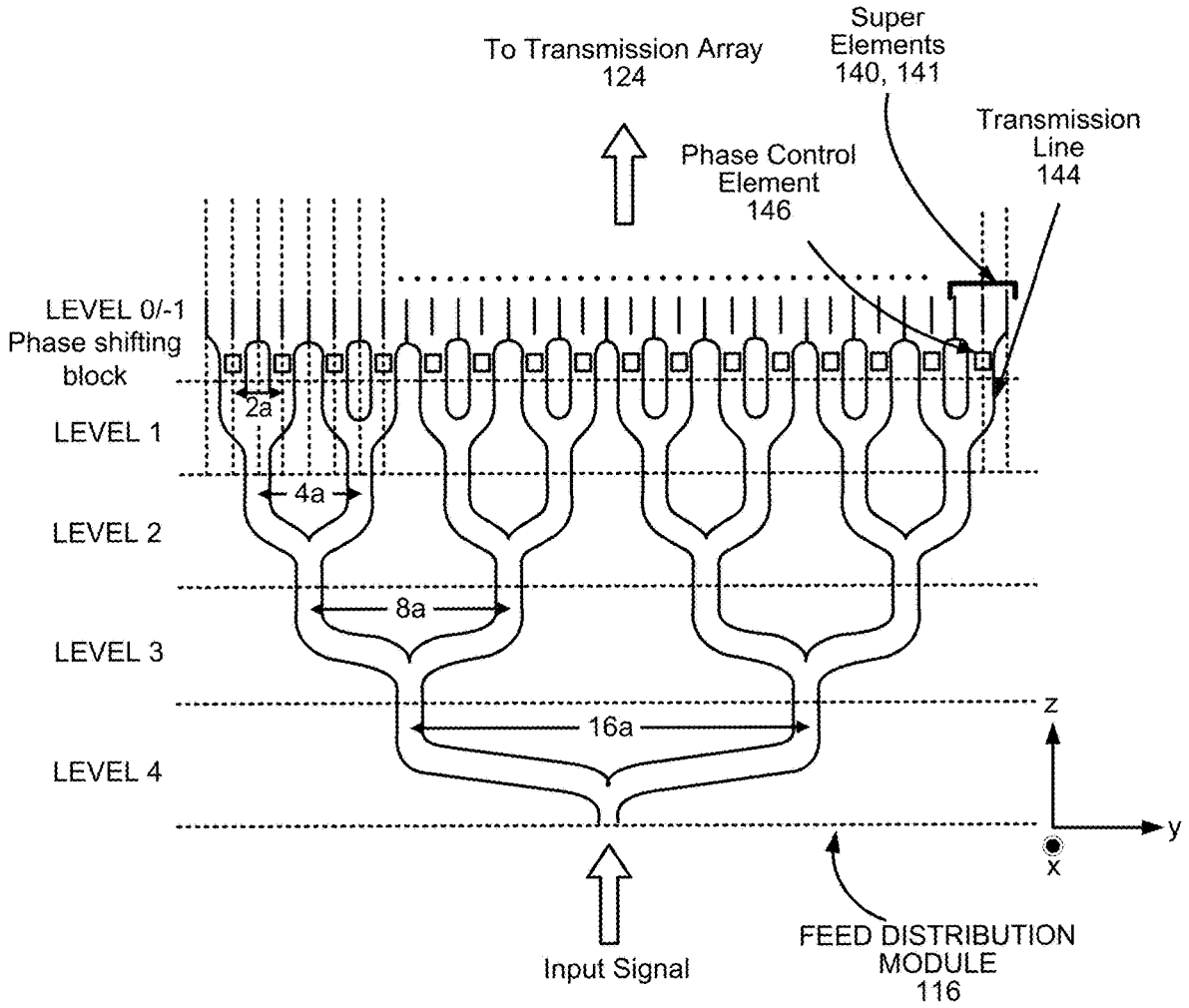
FIG. 2 illustrates a cross-sectional schematic diagram of the feed distribution module that provides a corporate feed dividing the transmission signals, according to some implementations of the subject technology.

FIG. 2 illustrates a cross-sectional schematic diagram of the feed distribution module 116 that provides a corporate feed dividing the transmission signals received for propagation to multiple super elements (e.g., 140, 141), according to some implementations of the subject technology. In this implementation, the feed distribution module 116 is a type of power divider circuit. The input signal is fed in through the various paths. This configuration is an example and is not meant to be limiting to the specific structure disclosed.

Within the feed distribution module 116 is a network of paths, in which each of the division points is identified according to a division level. As depicted in FIG. 2, the feed distribution module 116 includes a first level of transmission lines (depicted as LEVEL 0), a second level of transmission lines (depicted as LEVEL 1), a third level of transmission lines (depicted as LEVEL 2), a fourth level of transmission lines (depicted as LEVEL 3), and a fifth level of transmission lines (depicted as LEVEL 4). The distance between two paths originating from a common division point may be fixed for other paths on a same level, but the distance between paths on other levels may be different. For example, the transmission lines split off from a common division point on LEVEL 1 may be separated by a first distance (depicted as 2*a*), whereas, the transmission lines split off from a common division point on LEVEL 2 may be separated by a second distance (depicted as 4*a*), which is greater than the first distance (or 2*a*). In another example, the transmission lines split off from a common division point on LEVEL 3 may be separated by a third distance (depicted as 8*a*) that is greater than the second distance (or 4*a*), whereas the transmission lines split off from a common division point on LEVEL 4 may be separated by a fourth distance (depicted as 16*a*), which is greater than the third distance (or 8*a*). In this implementation, the paths have similar dimensions; however, the size of the paths may be configured differently to achieve a desired transmission and/or radiation result. The transmission lines of the feed distribution module 116 may reside in a substrate of the radiating structure 200.

In some aspects, the transmission lines on LEVEL 0 include phase shifting blocks on respective transmission line paths. The feed distribution module 116 may include a phase shifting block on each transmission line on LEVEL 0. In some implementations, the phase shifting block includes the reactance control module 146. In some aspects, the reactance control module 146 may be positioned otherwise within the paths leading to one or more super elements. In some implementations, the reactance control module 146 is incorporated into a transmission line 144. There are a variety of ways to couple the reactance control module 146 to one or more transmission lines. As illustrated, the other paths of LEVEL 1 have reactance control mechanisms that may be the same as the reactance control module 146.

As illustrated in FIG. 2, the transmission line 144 is located on LEVEL 1, which is the level of paths feeding one or more super elements of the transmission array structure 124. The transmission line 144 includes a reactance control module 146 and is coupled to super elements 140 and 141. The reactance control module 146 acts to change the reactance of the transmission line 144, resulting in a change to the signal propagating through the transmission line 144 to the super elements 140, 141. The reactance control module 146 also can affect both super elements. In operation, the feed distribution module 116 receives input signals, which propagate through the network of paths to the transmission array structure 124.

Figure 3:
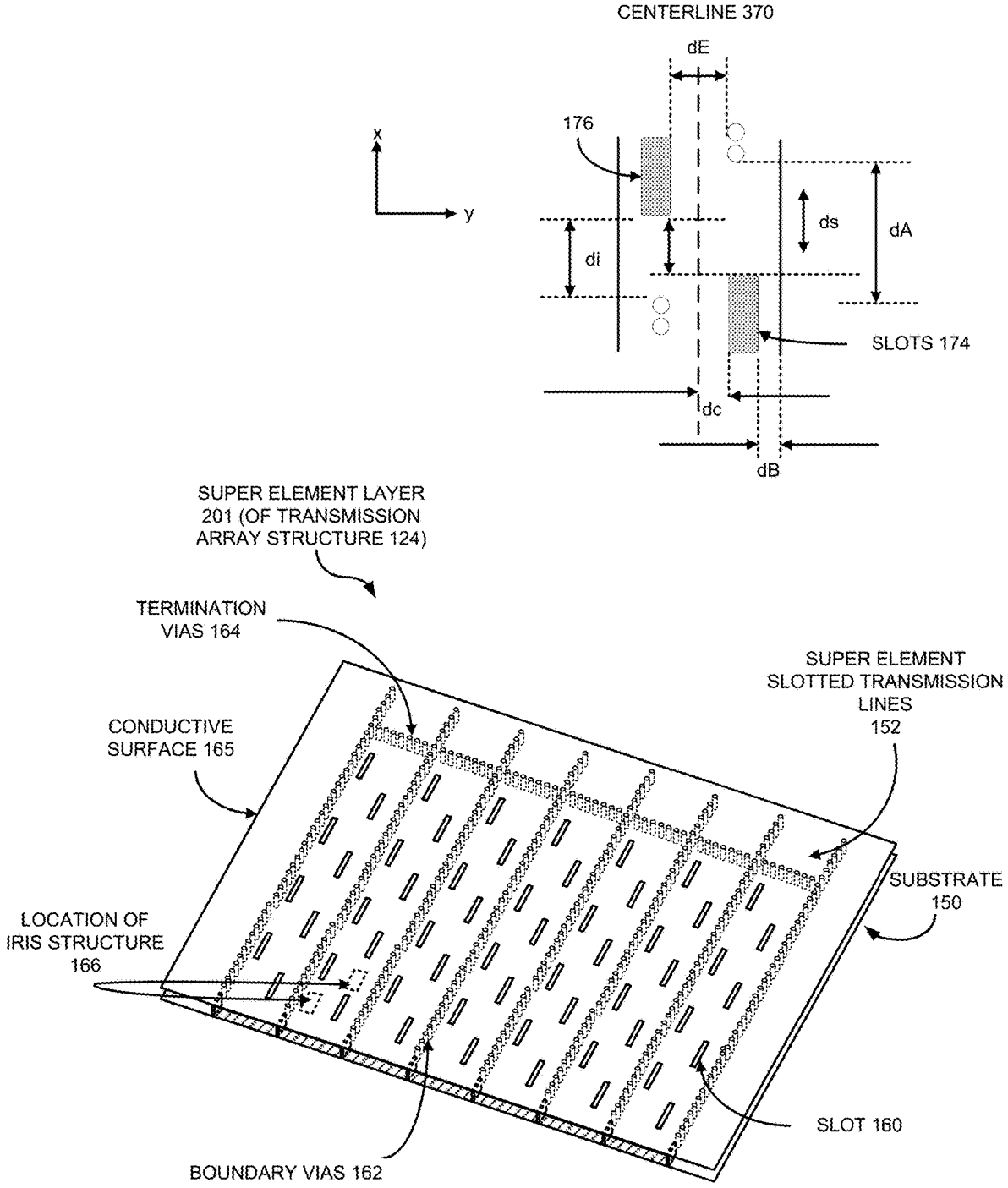
FIG. 3 illustrates a top view of a transmission array layer, according to some implementations.

FIG. 3 illustrates a top view of a transmission array or super element layer 201, which is part of the transmission array structure 124 within radiating array structure 200, according to some implementations. The radiating structure 200 is a composite substrate having multiple layers, in which the transmission array layer 201 is formed of two conductive layers and a dielectric therebetween. The substrate may be formed of a Polytetrafluoroethylene (PTFE) composite material having specific parameters, such as, among others, low dielectric loss, that is applicable to high-frequency circuits. For example, a PTFE composite laminate product can exhibit thermal and phase stability across temperature, and is used in automotive radar and microwave applications. As depicted in FIG. 3, the transmission array layer 201 is, or includes at least a portion of, the substrate 150, in which transmission lines in the radiating array structure 200 are configured for propagation of a transmission signal from the input to each transmission line.

As illustrated in FIG. 3, this portion of the transmission array structure 124 includes multiple super elements, each of which behaves as a slotted wave guide to feed the unit cell elements 20 on the radiating array structure 126. In some implementations, a pair or set of transmission lines forms a super element of slotted transmission lines 152. The signal propagates through the super element of slotted transmission lines 152, and radiates through discontinuities in a conductive surface 165 of the transmission array layer 201. In this implementation, the MTM array (depicted as the "radiating array structure 126" in FIG. 1) is configured to overlay the conductive surface 165 of the transmission array layer 201. In some implementations, the radiating array structure 126 (not shown in FIG. 3) is positioned above (or disposed on) the conductive surface 165 and includes the MTM elements (depicted as "unit cell elements 20" in FIG. 1) that receive the signals from transmission array layer 201 and generate the transmission beams. Each unit cell element 20 is designed and configured to support the specified radiation patterns.

The transmission array layer 201 also includes iris structures 166, which are formed in the substrate 150 to direct and maintain the radiated signals to the MTM elements of the radiating array structure 126. These may be positioned in a variety of configurations depending on the structure and application of the radiating structure 200. As depicted in FIG. 3, the location of the iris structures 166 corresponds to a location where two iris structures are positioned opposite a slot (e.g., 160) with respect to centerline 170.

The antenna structure of FIG. 3 may be referred to as a type of slotted wave guide antenna (SWGA), in which the SWGA acts as a feed to the radiating array structure 126. The SWGA portion includes the following structures and components: a full ground plane, a dielectric substrate, a feed network, such as direct feeds to the multi-ports transceiver chipset, an array of antenna or complementary antenna apertures, such as slot antenna, to couple the electromagnetic field propagating in the SIW with metamaterial structures located on top of the antenna aperture. The feed network may include passive or active lump components for matching phase control, amplitude tampering, and other RF enhancement functionalities. The distances between the metamaterial structures can be much lower than half the wavelength of the radiating frequency of the transmission signal. Active and passive components may be placed on the metamaterial structures with control signals either routed internally through the radiating structure 200 or external through or on upper portions of the substrate.

Alternate implementations may reconfigure and/or modify the radiating structure 200 to improve radiation patterns, bandwidth, side lobe levels, and so forth. The SWGA loads the metamaterial structures to achieve the desired results. The antenna performance may be adjusted by design of the radiating structure 200 features and materials, such the shape of the slots 160, slot patterns, slot dimensions, conductive trace materials and patterns, as well as other modifications to achieve impedance matching and so forth. The substrate 150 may have two portions of dielectric material separated by a slotted transmission line positioned therebetween. The slotted transmission line is disposed on a substrate 150, in which each transmission line is within a bounded area; where the boundary is a line of vias cut through (or penetrate through) the conductive surface 165 (depicted as "boundary vias 162"). The slots 160 are configured within the conductive layer 165 and spaced apart as illustrated in FIG. 3, in which the slots 160 are positioned symmetrically with respect to the center line 170. Each bounded transmission line is referred to herein as a "super element" such as super element of slotted transmission lines 152. In some implementations, the layer 201 includes a line of termination vias that penetrate through the conductive surface 165, and are arranged orthogonal to the boundary vias 162.

A region on a super element is reproduced for clarity of understanding. The region depicts the slots as being equidistant from a center line, such as centerline 170, where slots 174 and 176 on opposite sides of the centerline 170, are equidistant to the center line 170 and are staggered with respect to one another along the direction thereof. For example, the slots 174 and 176 are staggered and have a distance in the x-direction of $d_X$. The distance in the y-direction from the edge of a slot to the boundary via is given as $d_B$, and the distance from the centerline 170 to the slot is given as $d_C$. The iris structures 166 are illustrated as two consecutive vias that are directly opposite a slot along the y-axis, and located laterally from a different slot along the x-axis. The distance in the x-direction between a first iris structure and slot 174 is given as $d_s$, whereas the distance in the x-direction between a second iris structure and slot 176 is given as $d_i$. The distance between sets of iris structures 166 in the x-direction is $d_A$, and the distance between the set of iris structures 166 and the edge of the slot in the y-direction is illustrated as $d_E$. The value of $d_i$ may be equivalent to the value of $d_S$ in some implementations, or the values of $d_i$ and $d_s$ are different in other implementations. The various distances, positions and configurations of iris structures may be adjusted, changed and designed according to the application.

Figure 4:
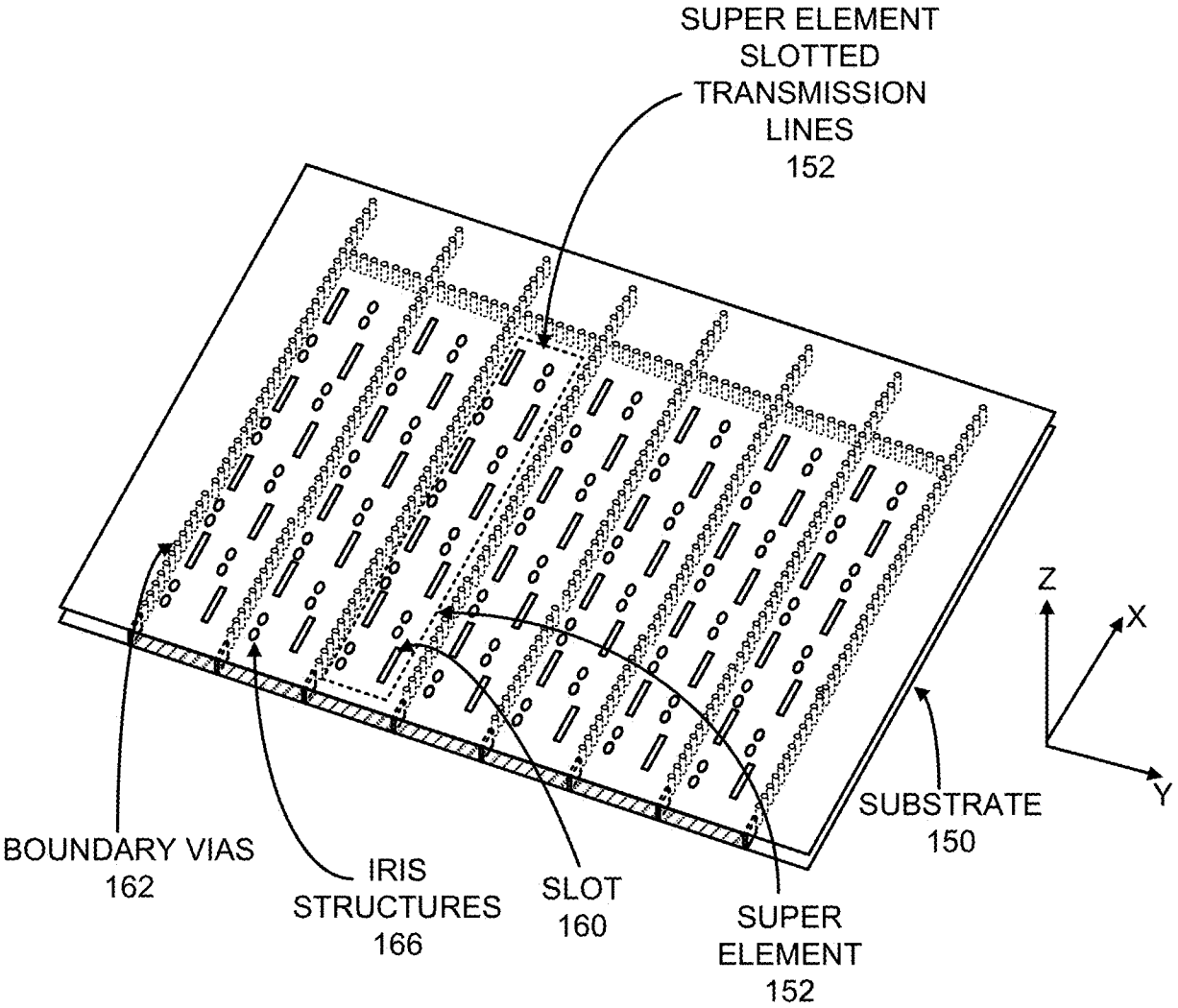
FIG. 4 illustrates a perspective view of the transmission array structure according to some implementations of the subject technology.

FIG. 4 illustrates a perspective view of the transmission array structure 124 according to some implementations of the subject technology. The transmission array structure 124 includes a substrate 150 and a transmission array layer 201. Not all of the depicted components may be used, however, and one or more implementations may include additional components not shown in the figure. Variations in the arrangement and type of the components may be made without departing from the scope of the claims set forth herein. Additional components, different components, or fewer components may be provided.

As depicted in FIG. 4, the transmission array layer 201 is disposed on the substrate 150 along the z-axis. The transmission array layer 201 includes one or more super elements, such as super element of slotted transmission lines 152, which is positioned with length along the x-direction. The super element of slotted transmission lines 152 is defined by opposing lines of boundary vias 162. The portion of transmission array structure 124 has boundary vias 162 positioned along the length of the super element of slotted transmission lines 152 in the x-direction. In each super element, the transmission array layer 201 includes slots 160 and iris structures 166. The iris structures 166 are formed through the conductive surface 165 at the positions illustrated and act to contain the radiation pattern through the slots 160. These may be implemented at various locations along the super elements, and may include any number of vias depending on the desired radiation pattern and antenna behavior. In one or more implementations, the iris structures 166 are vias and are similarly shaped and sized. Other implementations may implement different shapes, configurations and sizes to achieve a desired result for an application, such as that of FIG. 5, which illustrates a portion of the transmission array structure 124 having iris structures 166 positioned closer to an edge of the slots 160.

Figure 5:
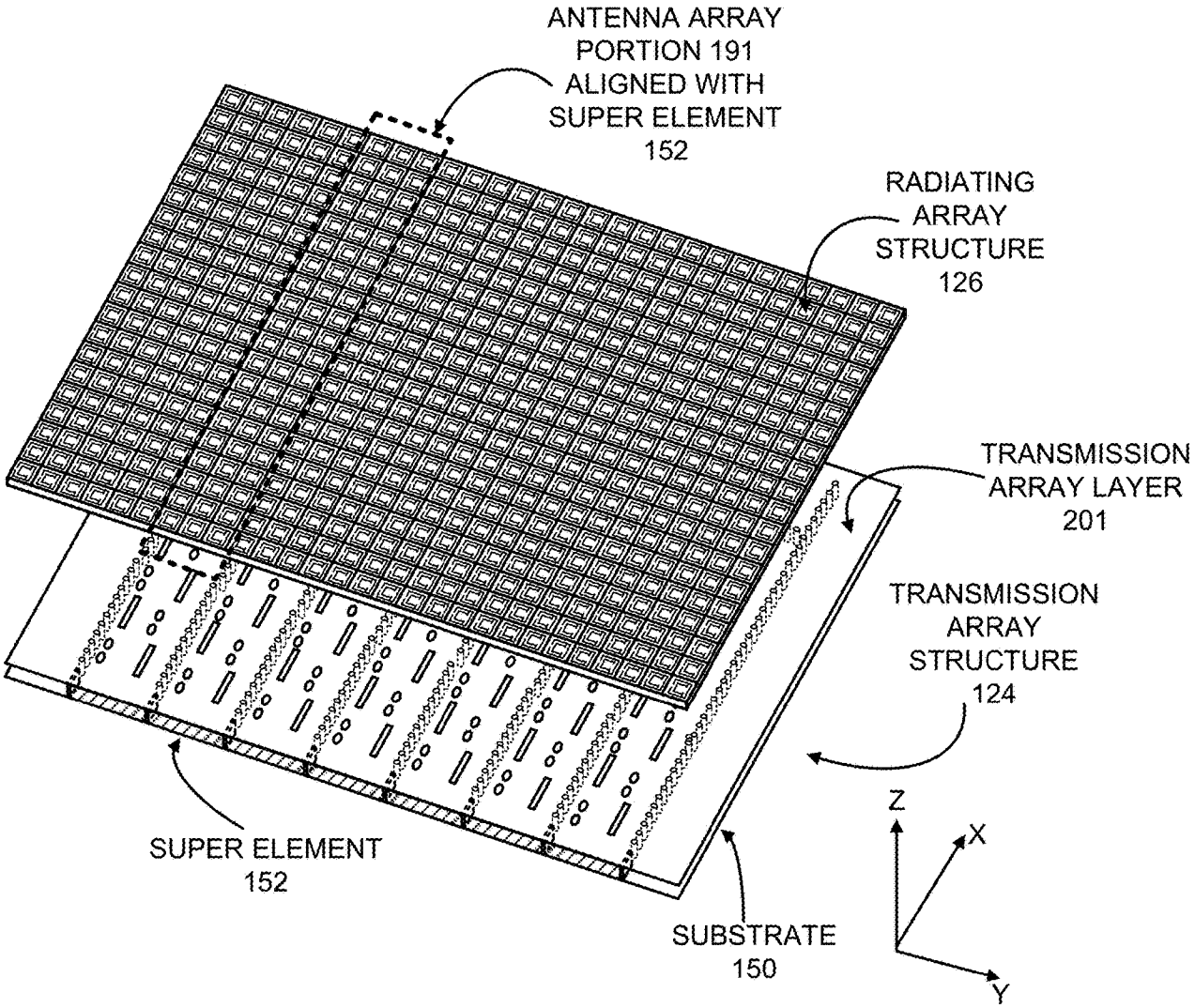
FIG. 5 illustrates an exploded view of the radiating structure, according to some implementations of the subject technology.

FIG. 5 illustrates an exploded view of the radiating structure 200, according to some implementations of the subject technology. The radiating structure 200 includes the radiating array structure 126 positioned proximate to the transmission array structure 124. As illustrated, the radiating array structure 126 is positioned above the transmission array structure 124 in the z-direction, which is the direction in which signals radiate through the radiating array structure 126. The radiating array structure 126 may be coupled to the transmission array structure 124 having one or more layers therebetween. In some implementations, the layering between the various layers of the radiating structure 200 includes an air gap formed therebetween.

The radiating array structure 126 is made up of a pattern of MTM elements, such as unit cell elements 20 of FIG. 1. The radiating array structure 126 may include a periodic and uniform arrangement of unit cell elements 20 positioned to interact with the super elements. These MTM elements are positioned with respect to the super elements of the transmission array structure 124. In some implementations, the radiating array structure 126 includes an antenna array portion having a subset number of MTM elements that are aligned with the super element 152. The alignment can be observed by dashed lines that delineate the super element 152 on the conductive surface 165 of the transmission array layer 201. In this respect, the corresponding subarray of MTM elements 191 interacts with the super element 152 for transmission of signals.

In operation, the radiating array structure 126 receives a transmission signal from the slots of the super element 152. The transmission signal from the super element 152, for example, is received by the subarray of MTM elements 191 and is radiated over the air. In some implementations, the super elements of the transmission array structure 124 are positioned lengthwise along the x-direction, and enables scanning in that direction. In some examples, the x-direction corresponds to the azimuth or horizontal direction of the radar; the y-direction corresponds to the elevation direction; and the z-direction corresponds to the direction of the radiated signal.

In some implementations, the iris structures 166 are, or at least include, vias formed through all or a portion of the layers of the substrate 150. The iris structures 166 may have a cylindrical shape, but may have other shapes, such as a rectangular prism shape. The vias are disposed with a conductive material and may serve as an impedance to the electromagnetic wave propagating through the super elements (e.g., 152).

Figure 6:
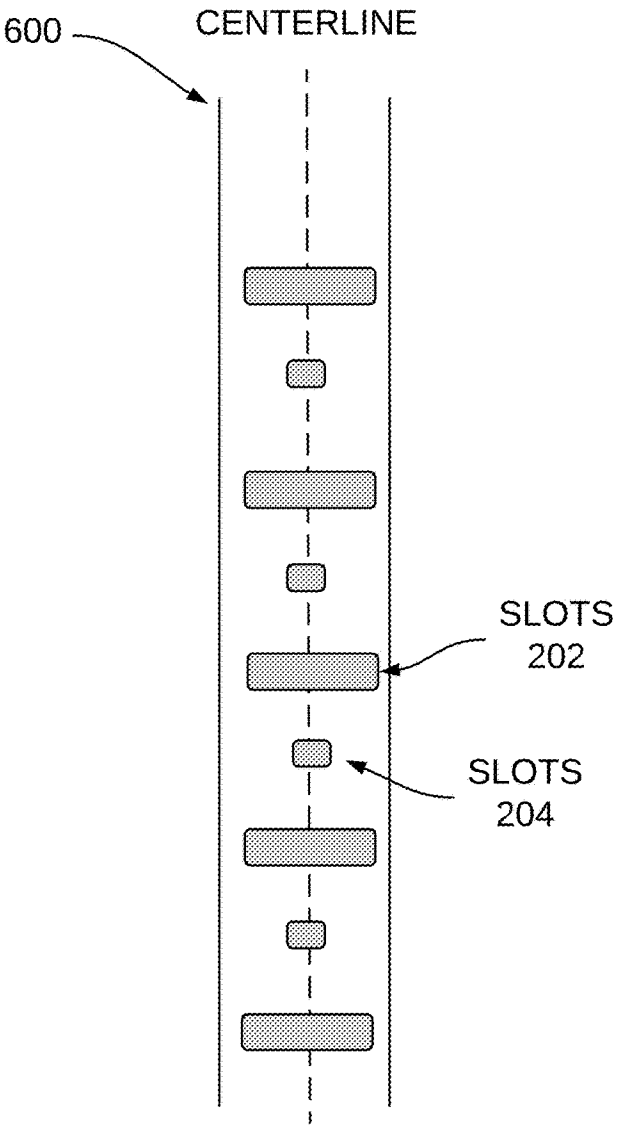
FIG. 6 illustrates a top view of a schematic diagram depicting an arrangement of slots according to some implementations of the subject technology.

FIG. 6 illustrates a top view of a schematic diagram depicting an arrangement 600 of slots according to some implementations of the subject technology. The arrangement 600 includes a configuration for a super element having multiple slots 202 positioned orthogonal to the length of the super element. For example, the length of the slots 202 may be defined along an axis that is orthogonal to the centerline. In some implementations, slots 204 are interposed between each of the slots 202 along the length of the centerline. As depicted in FIG. 6, the length of each of the slots 204 is smaller than that of the slots 202. In other implementations, the length of the slots 204 may be equivalent to that of the slots 202. In still other implementations, the length of the slots 204 may be greater than that of the slots 202.

Figure 7:
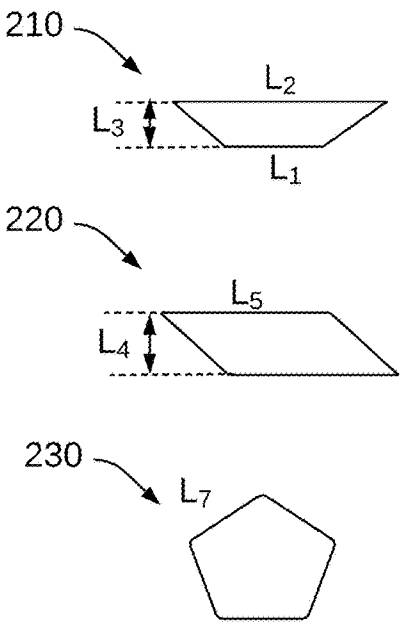
FIG. 7 illustrates a cross-sectional view of various shapes for slots within a super element of the transmission array structure, according to some implementations of the subject technology.

FIG. 7 illustrates a cross-sectional view of various shapes for slots within a super element of the transmission array structure 124, according to some implementations of the subject technology. A slot shape 210 is a trapezoid having different side lengths $L_1$, $L_2$, and a height of $L_3$. In some implementations, the length of $L_1$ is different than the length of $L_2$. As illustrated in FIG. 7, the length of $L_2$ is greater than that of $L_1$. The slot shape 210 may be positioned in any of a variety of orientations within a super element to optimize a transmission signal having a desired frequency range. Similarly, a slot shape 220 is a parallelogram having a length $L_5$ and height $L_4$. In another example, a slot shape 230 is a hexagon with each side having a length $L_7$. The slot shapes of FIG. 7 include different types of shapes that may be used for the slots in the super element. These may be used with varying sizes, orientations and combinations.

Figure 8B:
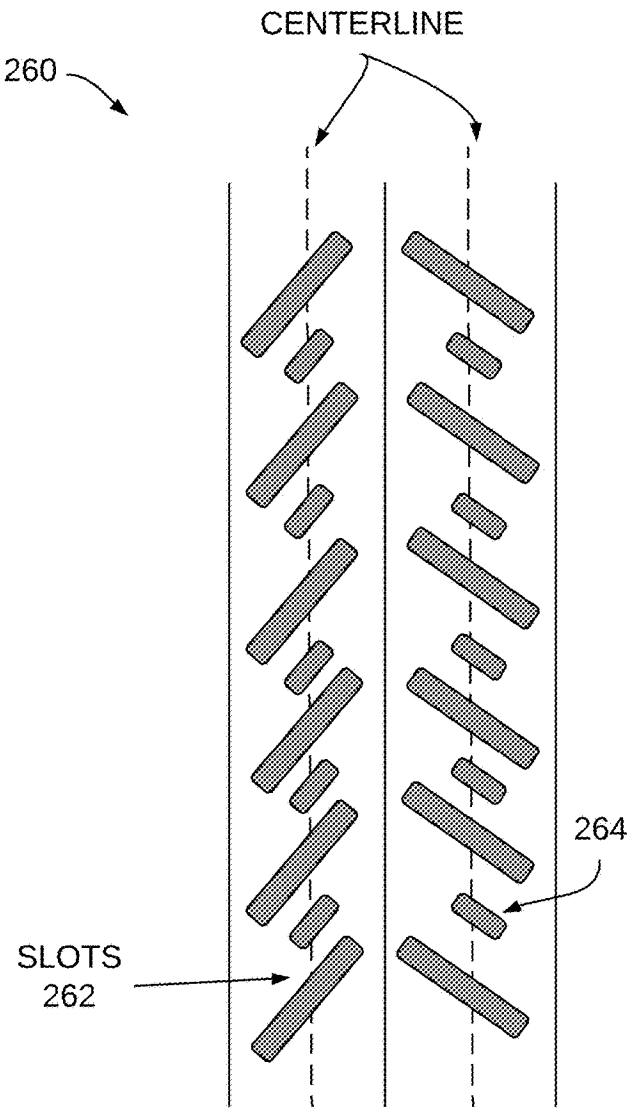
FIGS. 8A and 8B illustrate different configurations for slots within a super element of the transmission array structure, according to some implementations of the subject technology.
Figure 8A:
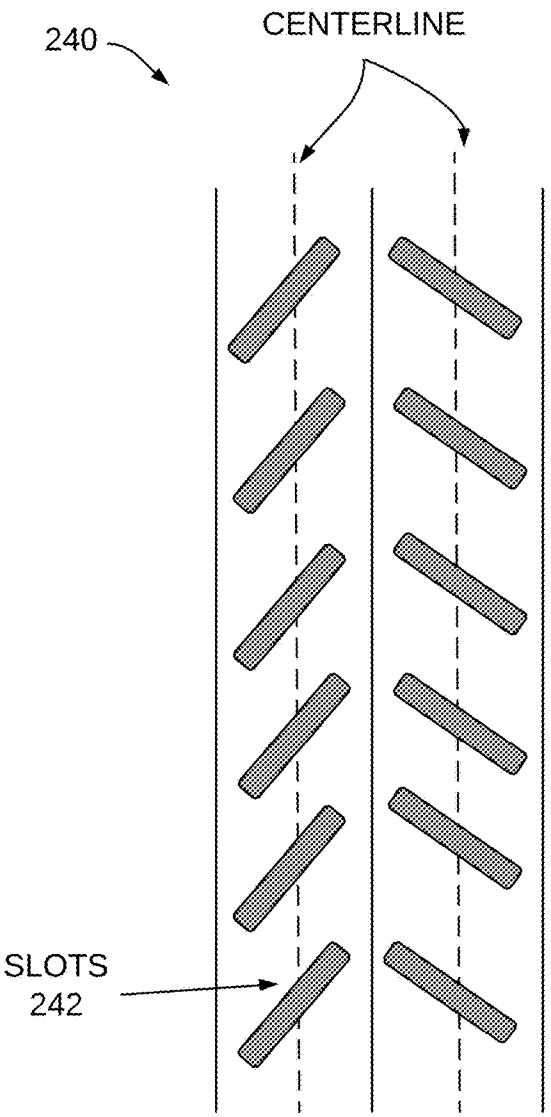

FIGS. 8A and 8B illustrate different configurations for slots within a super element of the transmission array structure 124, according to some implementations of the subject technology. In FIG. 8A, a slot configuration 240 includes slots 242 that are arranged on a diagonal orientation relative to a centerline along the length of the super element. In the slot configuration 240, the slots 242 are all the same size and are angled toward each other. In FIG. 8B, a slot configuration 260 includes slots 262 and 264 that are arranged on a diagonal orientation relative to a centerline along the length of the super element. The slots 262 and 264 are interleaved along the length of the super element 260. In some implementations, the slots 264 have a smaller length than the slots 262; however, the slot length between the slots 262 and 264 can vary depending on implementation.

Figure 9B:
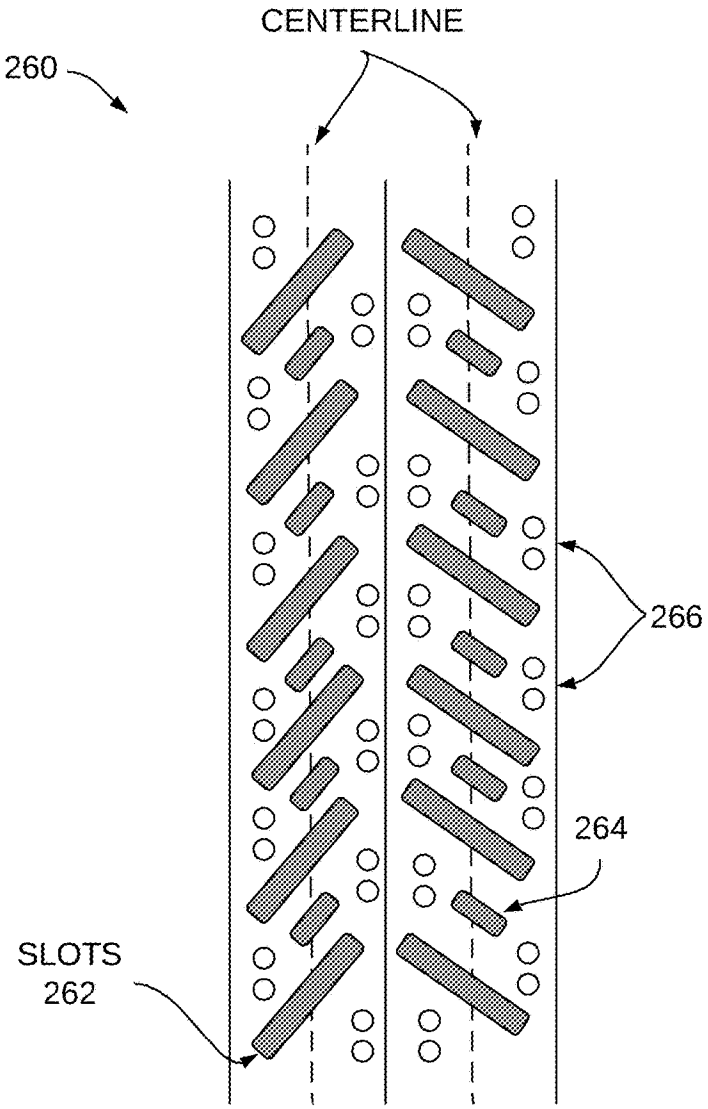
FIGS. 9A and 9B illustrate different configurations for slots within a super element of the transmission array structure, according to some implementations of the subject technology.
Figure 9A:
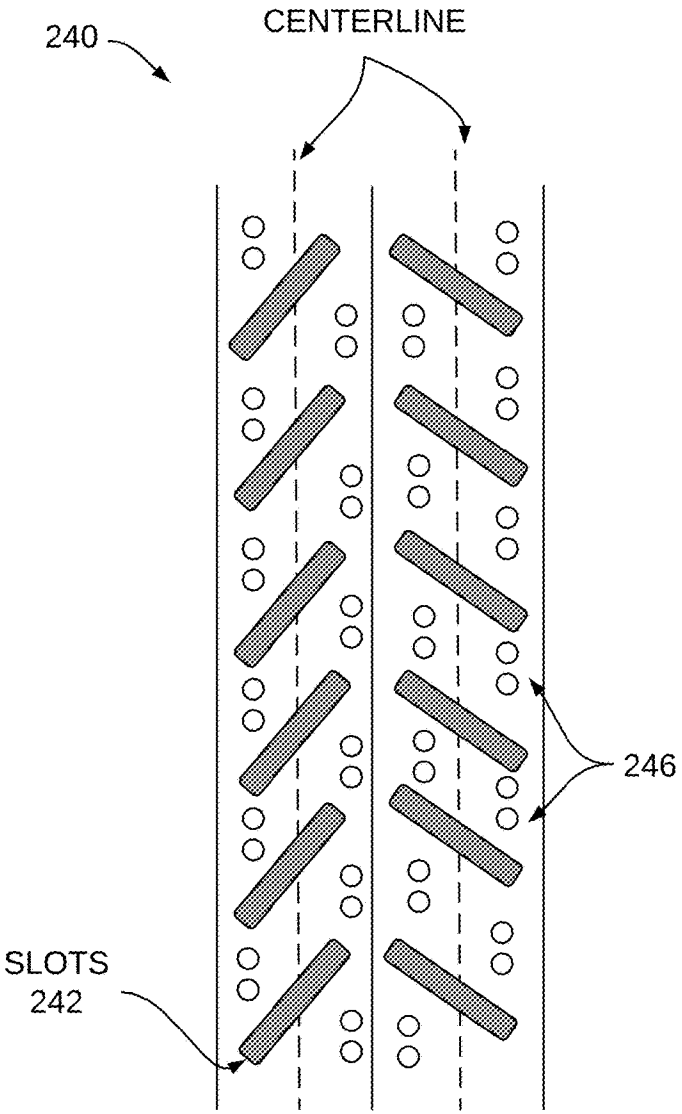

FIGS. 9 A and 9B illustrate different configurations for slots within a super element of the transmission array structure 124, according to some implementations of the subject technology. In FIG. 9A, a slot configuration 240 includes slots 242 that are arranged on a diagonal orientation relative to a centerline along the length of the super element. In the slot configuration 240, the slots 242 are all the same size and are angled toward each other. In FIG. 9B, a slot configuration 260 includes slots 262 and 264 that are arranged on a diagonal orientation relative to a centerline along the length of the super element. The slots 262 and 264 are interleaved along the length of the super element 260. In some implementations, the slots 264 have a smaller length than the slots 262; however, the slot length between the slots 262 and 264 can vary depending on implementation. The slot configurations 240 and 260 each has different configurations of iris structures arranged along the sides of the super elements. For example, FIG. 9A includes an iris configuration 246 that includes multiple pairs of iris structures (e.g., iris structures 166 of FIG. 4) interposed between the slots 242 along a periphery of the super element. In particular, the iris configuration 246 includes a first pair of iris structures positioned proximate to a first end of the slots 242 and a second pair of iris structures positioned proximate to a second end of the slots 242 (opposite to the first end). FIG. 9B includes an iris configuration 266 that includes multiple pairs of iris structures interposed between the slots 242 along a periphery of the super element. In particular, the iris configuration 246 includes a first pair of iris structures positioned proximate to a first end of the slots 264 and a second pair of iris structures positioned proximate to a second end of the slots 264.

Figure 10B:
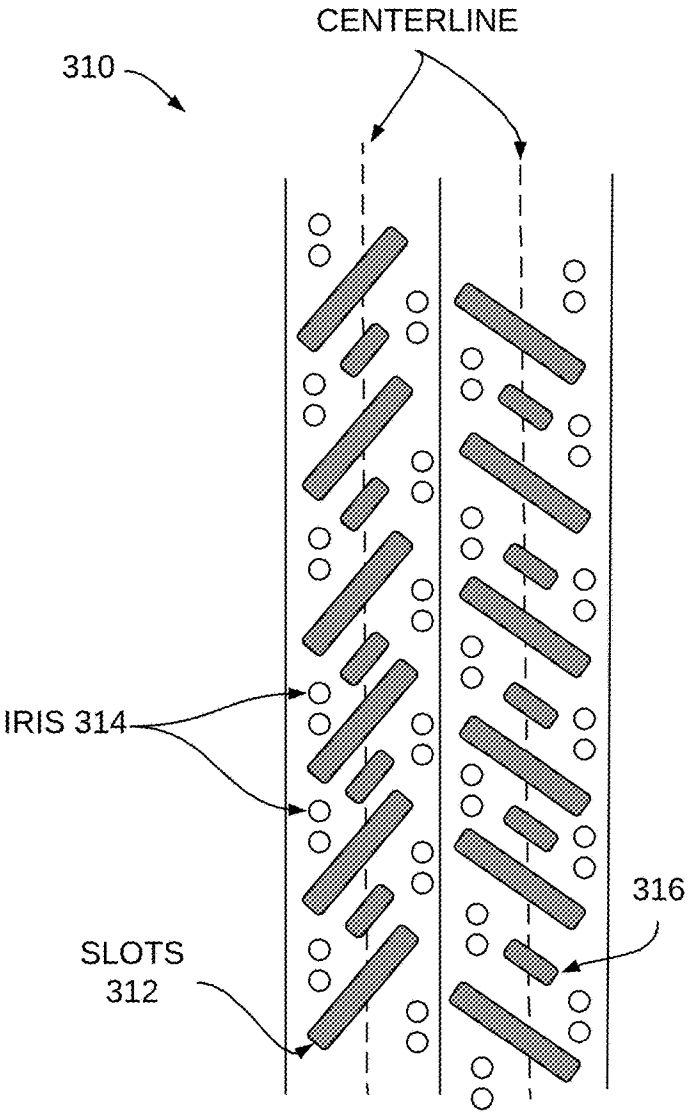
FIGS. 10A and 10B illustrate different asymmetric configurations for slots within a super element of the transmission array structure, according to some implementations of the subject technology.
Figure 10A:
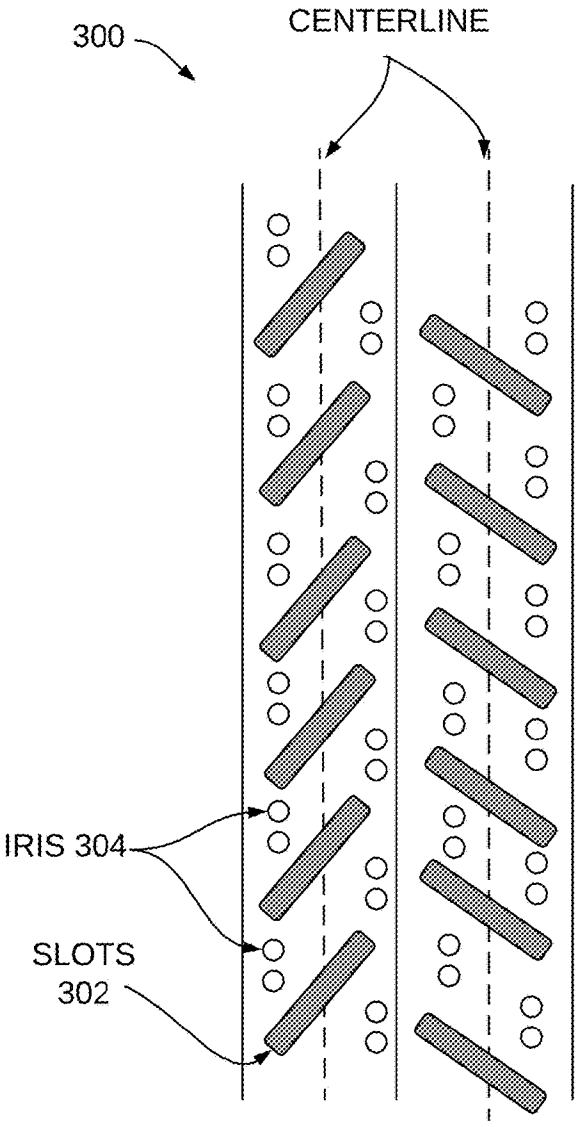

FIGS. 10A and 10B illustrate different asymmetric configurations for slots within a super element of the transmission array structure 124, according to some implementations of the subject technology. In FIG. 10A, a slot configuration 300 includes slots 302 that are arranged on a diagonal orientation relative to a centerline along the length of the super element and are arranged asymmetrical across the centerline. In the slot configuration 300, the slots 302 are all the same size and are angled toward each other. In FIG. 10B, a slot configuration 310 includes slots 312 and 316 that are arranged on a diagonal orientation relative to a centerline along the length of the super element. The slots 312 and 316 are interleaved along the length of the super element 310. In some implementations, the slots 316 have a smaller length than the slots 312; however, the slot length between the slots 312 and 316 can vary depending on implementation. The slot configurations 300 and 310 each has different configurations of iris structures arranged along the sides of the super elements. For example, FIG. 10A includes an iris configuration 304 that includes multiple pairs of iris structures (e.g., iris structures 166 of FIG. 4) interposed between the slots 302 along a periphery of the super element. In particular, the iris configuration 304 includes a first pair of iris structures positioned proximate to a first end of the slots 302 and a second pair of iris structures positioned proximate to a second end of the slots 302 (opposite to the first end). FIG. 10B includes an iris configuration 314 that includes multiple pairs of iris structures interposed between the slots 302 and adjacent to slots 316 along a periphery of the super element. In particular, the iris configuration 314 includes a first pair of iris structures positioned proximate to a first end of the slots 316 and a second pair of iris structures positioned proximate to a second end of the slots 316.

Figure 11:
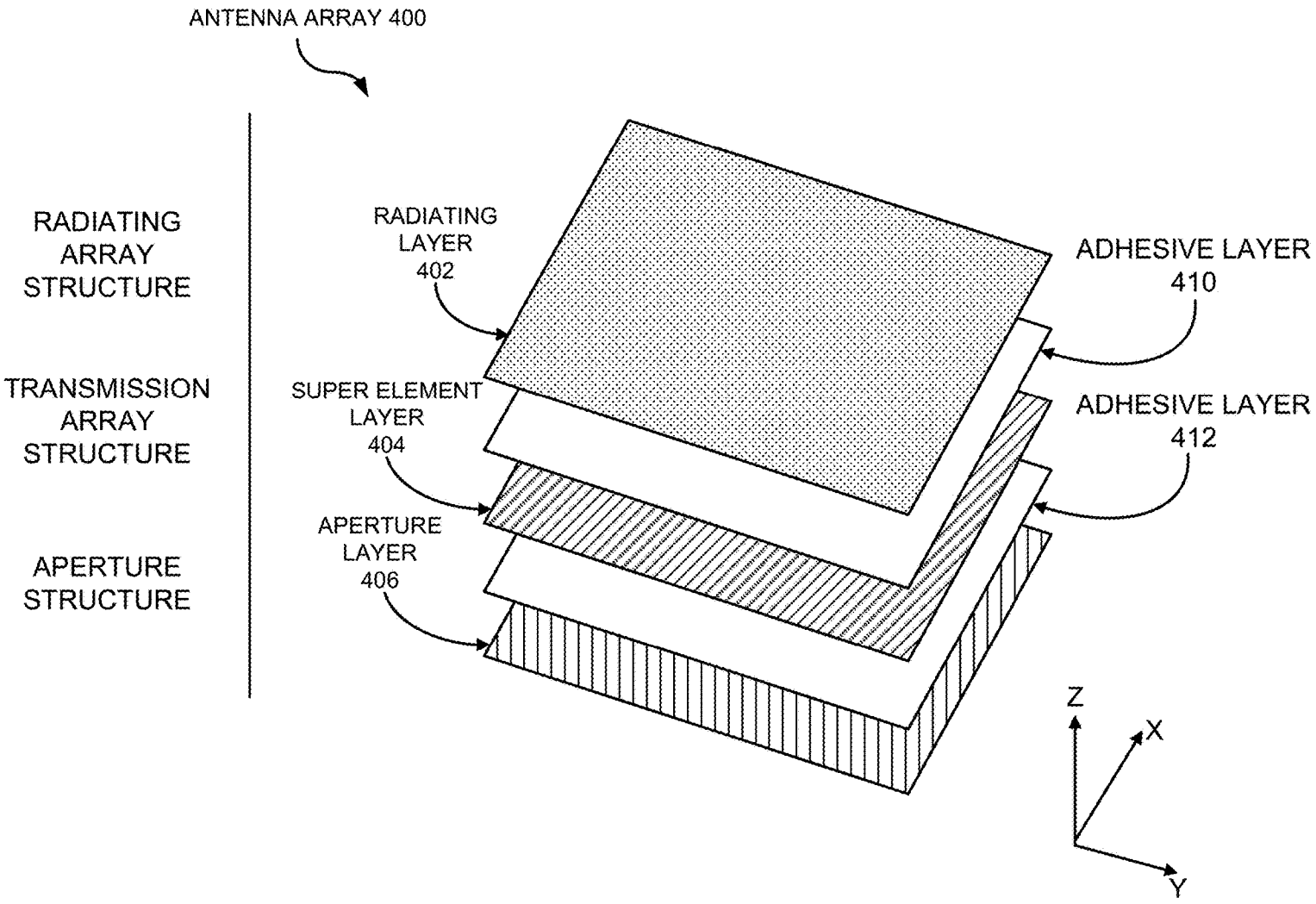
FIG. 11 illustrates an exploded view of an antenna array having a layer configuration for providing signals to radiating elements, according to some implementations of the subject technology.

FIG. 11 illustrates an exploded view of an antenna array 400 having a layer configuration for providing signals to radiating elements for transmission of electromagnetic waves over the air, according to some implementations of the subject technology. The antenna array 400 has an aperture layer 406, a super element layer 404 and a radiating layer 402. Not all of the depicted components may be used, however, and one or more implementations may include additional components not shown in the figure. Variations in the arrangement and type of the components may be made without departing from the scope of the claims set forth herein. Additional components, different components, or fewer components may be provided.

In the antenna array 400, the aperture layer 406 corresponds to a layer in an aperture structure that will be described in detail in FIG. 13, the super element layer 404 corresponds to a layer in the transmission array structure 124, and the radiating layer 402 corresponds to a layer in the radiating array structure 126. The aperture layer 406 is positioned proximate to the super element layer 404 along the z-axis. For example, the super element layer 404 may be disposed on a top surface of the aperture layer 406. In some implementations, the antenna array 400 includes an adhesive layer 412. The adhesive layer 412 may be interposed between the aperture layer 406 and the super element layer 404. In some aspects, the top surface of the aperture layer 406 may be adhered to a bottom surface of the super element layer 404 by the adhesive layer 412. The radiating layer 402 is positioned proximate to the super element layer 404 along the z-axis. For example, the radiating layer 402 may be disposed on a top surface of the super element layer 404. In some implementations, the antenna array 400 includes an adhesive layer 410. The adhesive layer 410 may be interposed between the radiating layer 402 and the super element layer 404. In some aspects, the top surface of the super element layer 404 may be adhered to a bottom surface of the radiating layer 402 by the adhesive layer 410. Each of the radiating layer 402, super element layer 404 and the aperture layer 406 have two conductive layers with a dielectric sandwiched between. A feed distribution network (e.g., the feed distribution module 116 of FIG. 2) provides signals to transmission lines formed in the aperture layer 406. The transmission lines correspond to the dimensions of the super elements, such that apertures in the aperture layer 406 effectively feed signals to the super elements of the super element layer 404. The signal then radiates through slots in the super elements to the radiating layer 402, which may be an MTM array or may be other radiating structures.

As illustrated in FIG. 11, the adhesive layer 410 is interposed between the radiating layer 402 and the super element layer 404, and the adhesive layer 412 is interposed between the super element layer 404 and the aperture layer 406. This composite structure enables control of the phase and direction of radiation patterns from the antenna array 400 while reducing and/or eliminating distortion over a frequency range of transmission signals, such as to reduce squint or undesired shifting that occurs when the frequency changes.

As described above, each of the radiating layer 402 and super element layer 404 has two conductive layers with a dielectric layer interposed between the two conductive layers. The super elements of the super element layer 404 are specified by vias formed through the super element layer 404. An adhesive material is provided between the different substrate layers. The vias are positioned to form transmission paths, and the vias may be lined or filled with conductive material, such that a top conductive layer is coupled to a bottom conductive layer.

Figure 12:
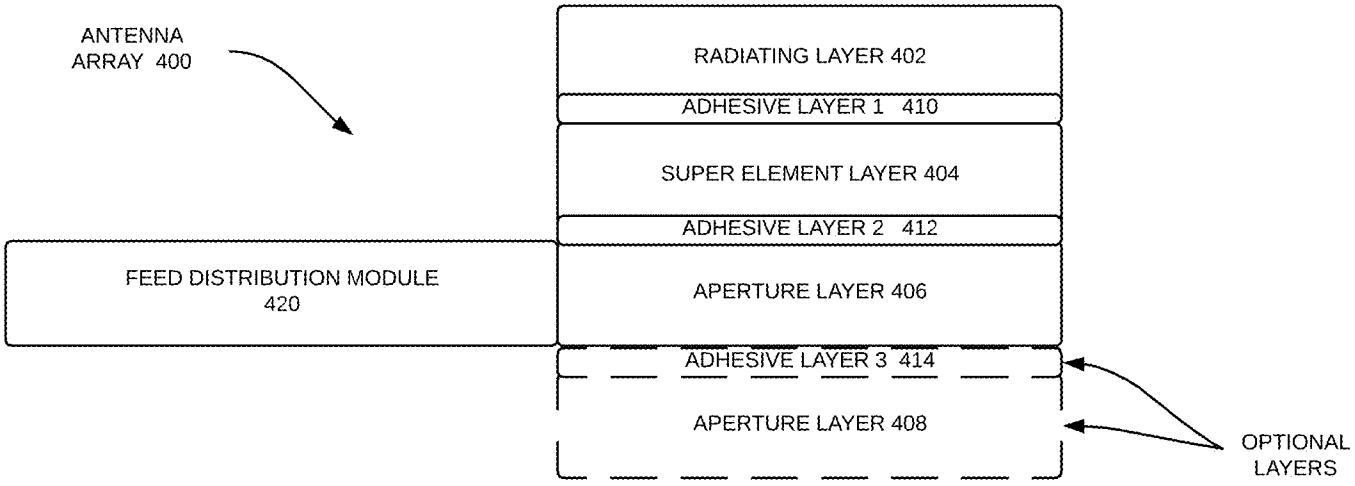
FIG. 12 illustrates a cross-sectional view schematic of an antenna array, according to some implementations of the subject technology.

FIG. 12 illustrates a cross-sectional view schematic of an antenna array 400 having an aperture layer 406, a super element layer 404 and a radiating layer 402, according to some implementations of the subject technology. A feed distribution module 420 is coupled to the aperture layer 406, and provides transmission signals to transmission lines formed in the aperture layer 406. The transmission signal travels through the aperture layer 406 and super element layer 404 to the radiating layer 402. In particular, the transmission signal travels through the transmission lines of the aperture layer 406, and radiates through apertures positioned within the transmission lines. The transmission signal may be aligned with respect to the position and shape of slots in super elements of the super element layer 404.

Additional layers may be disposed proximate to the aperture layer 406, such as optional adhesive layer 414 and aperture layer 408. As illustrated in FIG. 12, the adhesive layer 414 is interposed between the aperture layer 408 and the aperture layer 406, such that the aperture layer 408 may be adhered to the aperture layer 406 by the adhesive layer 414. The optional layers may be coupled to feed distribution networks of the feed distribution module 420 that provide transmission signals through these layers. The specific configuration of apertures in the aperture layer 408 is determined by estimated resultant radiation patterns, requirements, specifications, and the configuration and makeup of the other layers in the antenna array 400.

Figure 13:
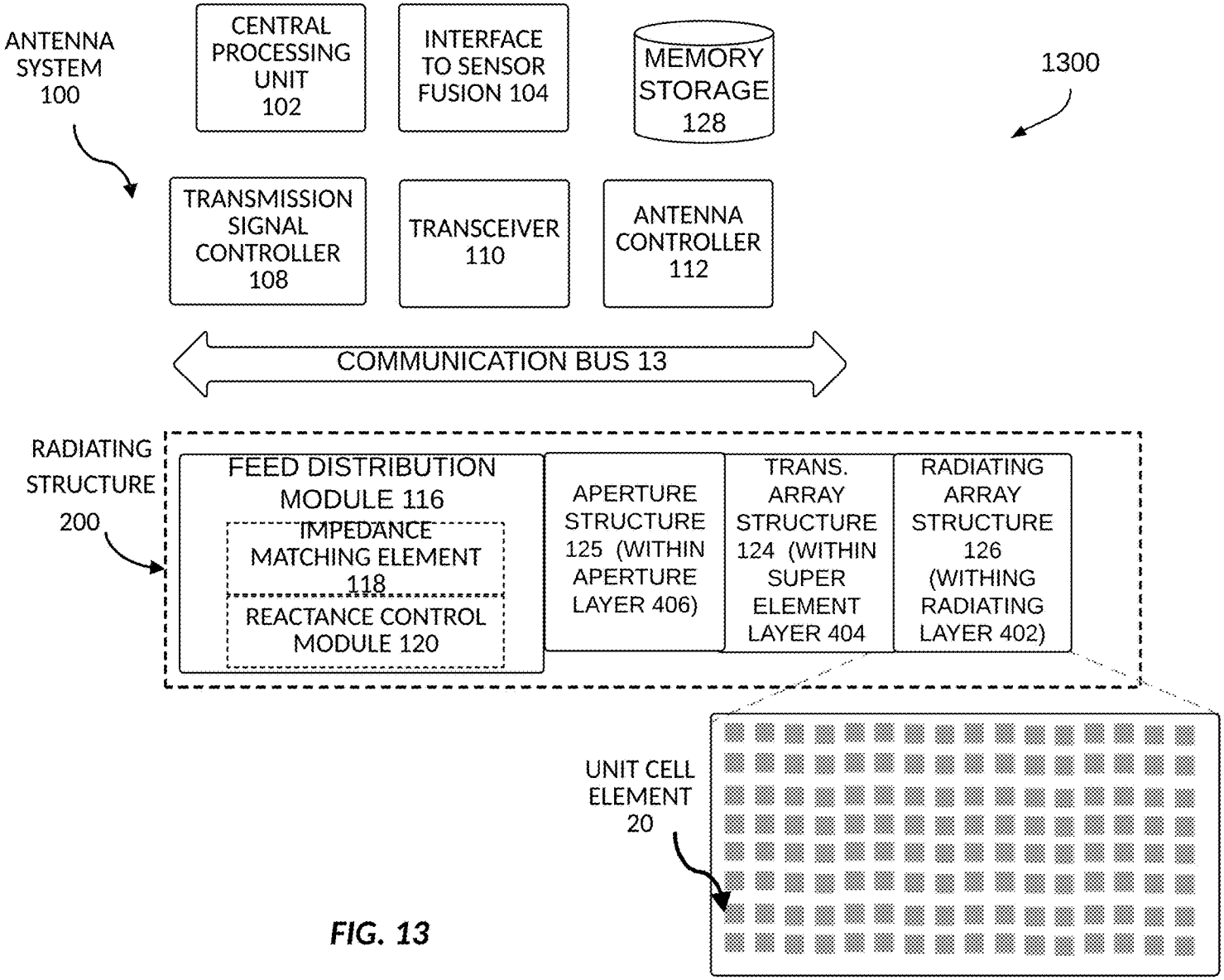
FIG. 13 conceptually illustrates an antenna array system having an antenna array and a radiating structure with an aperture structure, according to some implementations of the subject technology.

FIG. 13 conceptually illustrates an antenna array system 1300 having an antenna system 100 and a radiating structure 200 with an aperture structure 125, according to some implementations of the subject technology. The description of FIG. 13 is similar to the description of FIG. 1, and for purposes of explanation, only differences will be discussed in reference to FIG. 13. As depicted in FIG. 13, the antenna system 100 includes a central processing unit 102, an interface-to-sensor fusion 104, a transmission signal controller 108, a transceiver 110, an antenna controller 112, and a memory storage unit 128. The radiating structure 200 is communicably coupled to the antenna system 100 over a communication bus 13. The radiating structure 200 includes a feed distribution module 116, the aperture structure 125, a transmission array structure 124, and a radiating array structure 126. In some implementations, the aperture structure 125 is, or includes at least a portion of the aperture layer 406 (FIG. 11) and is coupled to the transmission array structure 124 within the super element layer 404 (FIG. 11). The arrangement of the components of the radiating structure 200 may correspond to the arrangement of components described in FIG. 12, such that the feed distribution module 116 is coupled directly to the aperture structure 125, and the transmission array structure 124 is interposed between and coupled to the aperture structure 125 and the radiating array structure 126.

Figure 14:
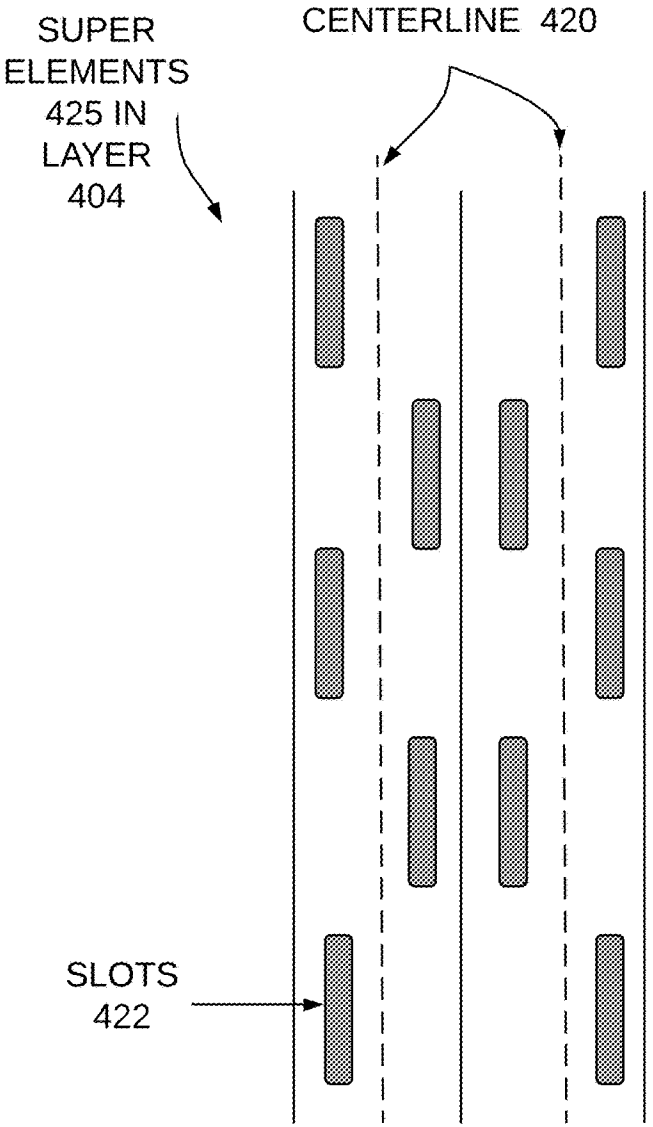
FIG. 14 illustrates a schematic diagram of a top view of the super element layer having a pair of super elements, according to some implementations of the subject technology.

FIG. 14 illustrates a schematic diagram of a top view of the super element layer 404 having a pair of super elements (e.g., 425), according to some implementations of the subject technology. The super element layer 404 includes slots 422 arranged in a specific pattern; however, other patterns, shapes, dimensions, orientations and specifications may be used to achieve a variety of radiation patterns from the antenna array 400. In some examples, the specific pattern of the slots 422 may include a lateral arrangement of the slots 422 along an axis that is parallel to the centerline 420. In some aspects, the slots 422 arranged in the specific pattern can be fed with a transmission signal by the aperture layer 406.

Figure 15:
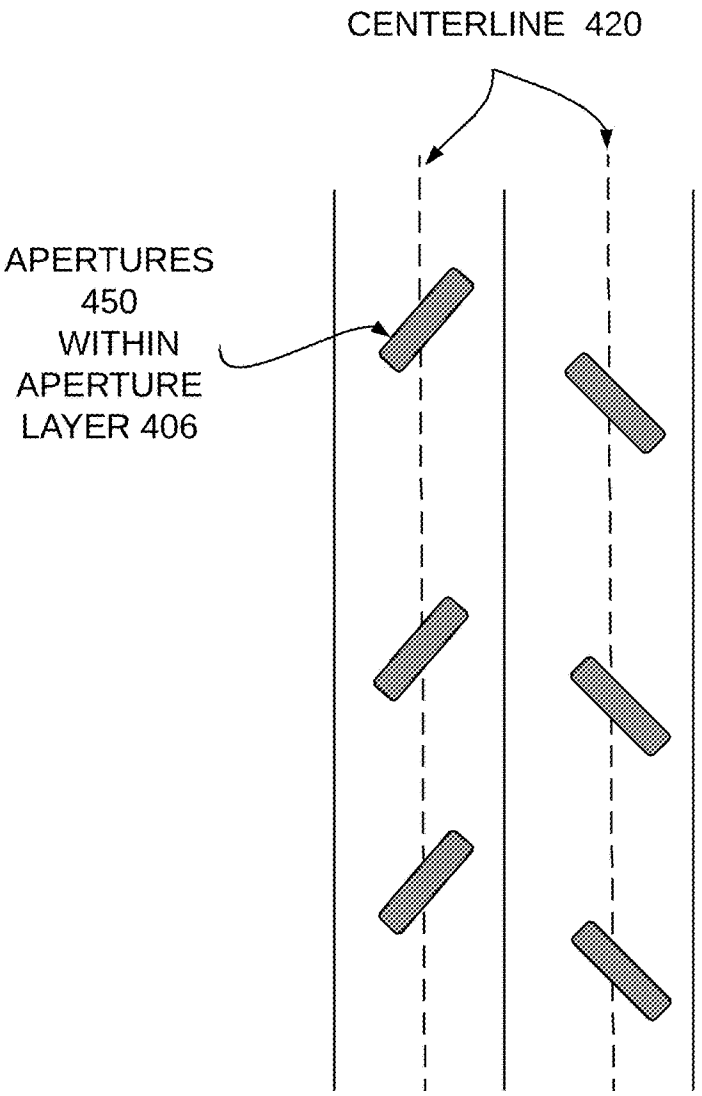
FIG. 15 illustrates a schematic diagram of a top view of the aperture layer having apertures, according to some implementations of the subject technology.

FIG. 15 illustrates a schematic diagram of a top view of the aperture layer 406 having apertures, according to some implementations of the subject technology. The aperture layer 406 includes apertures 450 arranged in a diagonal orientation relative to the centerline 420; however, other patterns, shapes, dimensions, orientations and specifications may be used to achieve a variety of radiation patterns from the antenna array 400. The apertures 450 are positioned to feed transmission signals to super elements 425 of the super element layer 404 (FIG. 14). The boundary lines defining transmission lines in the aperture layer 406 are aligned with the boundary lines defining the super elements 425 of the super element layer 404. These boundaries, or exclusion zones, are formed by vias formed through the individual layers that connect one conductive layer to another conductive layer.

Figure 16:
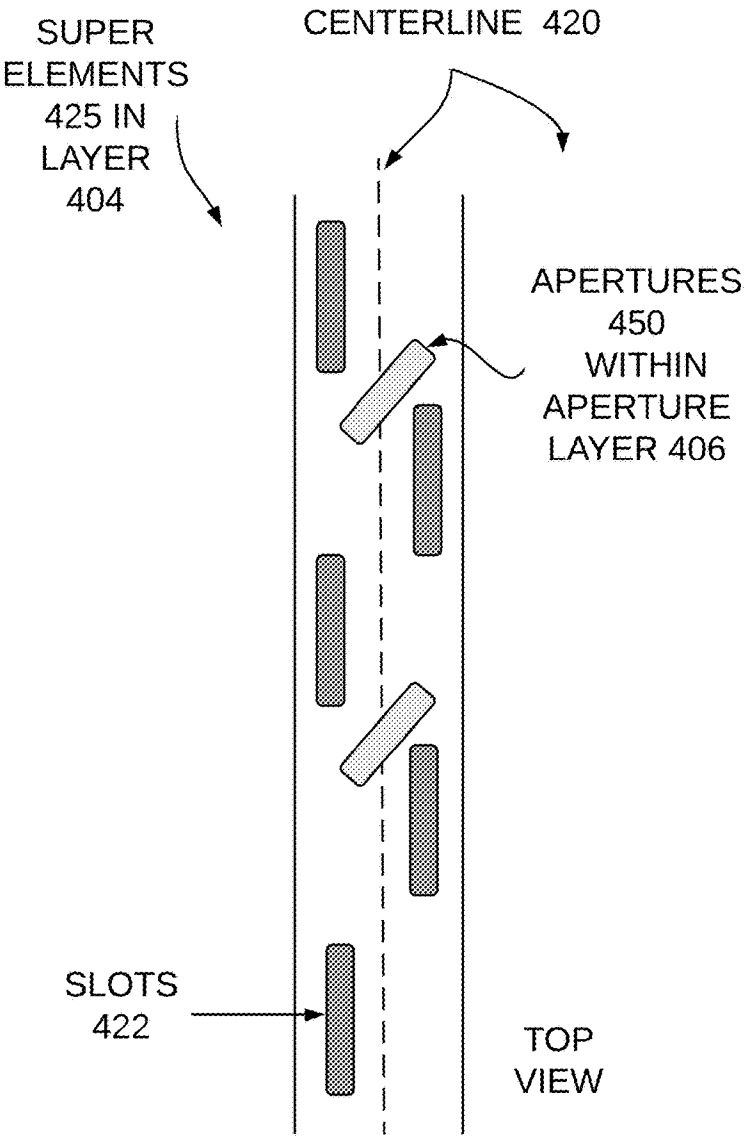
FIG. 16 conceptually illustrates a top view of the positional relationship between slots in a super element layer and apertures in an aperture layer, according to some implementations of the subject technology.

FIG. 16 conceptually illustrates a top view of the positional relationship between slots in a super element layer 404 and apertures in an aperture layer 406, according to some implementations of the subject technology. As illustrated in FIG. 16, the super element layer 404 is virtually superimposed over the underlying aperture layer 406 to illustrate the position of slots 422 on the super element layer 404 relative to apertures 450 on the aperture layer 406. The apertures 450 are angled with respect to the centerline 420 and interposed between staggered slots 422. In operation, the apertures 450 facilitate transmission of the transmission signals to the super elements on the super element layer 404. The components illustrated in FIG. 16 are not necessarily drawn to scale and are to provide clarity of understanding.

Figure 17:
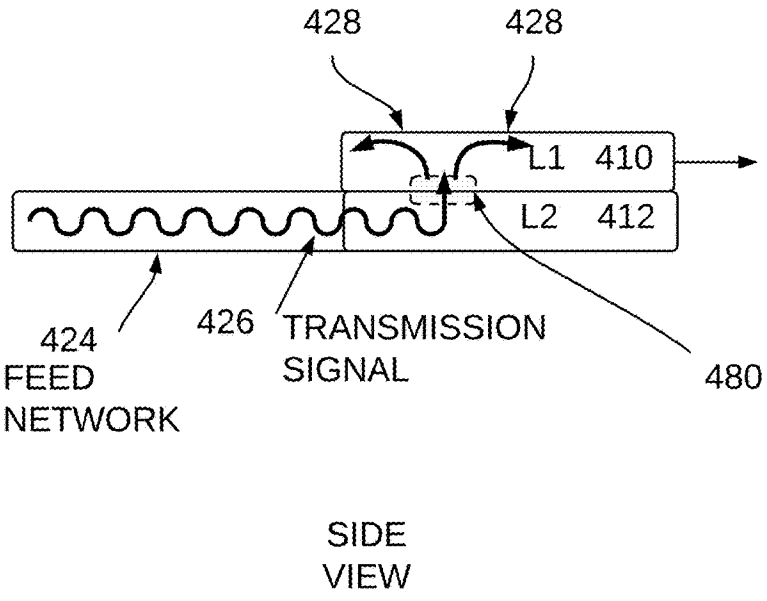
FIG. 17 illustrates a cross-sectional view of a portion of the antenna array, according to some implementations of the subject technology.

FIG. 17 illustrates a cross-sectional view of a portion of the antenna array having a feed network 424, an aperture layer 412, and a super element layer 410, according to some implementations of the subject technology. As illustrated in FIG. 17, a transmission signal 246 propagates through feed network 424 to aperture layer 412 and radiates through aperture 480 to super element layer 410, propagating as transmission signals 428. In some aspects, a radiating layer (not shown) is disposed on the super element layer 410, in which the transmission signals 428 may radiate through the radiating layer. In some implementations, the phase shift may be accomplished in one dimension, such as azimuth or elevation. In other implementations, the phase shift may be accomplished in multiple dimensions.

Figure 18:
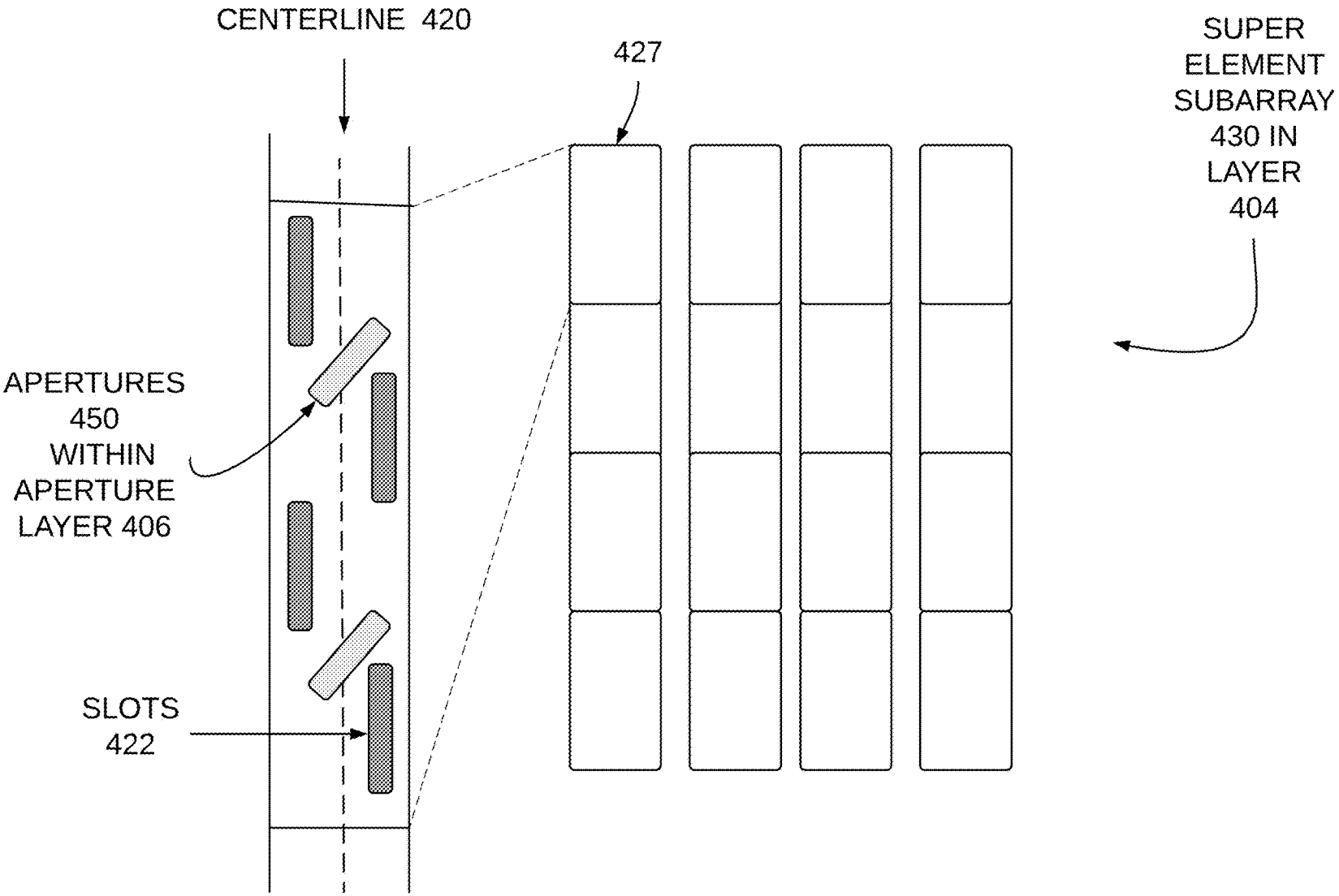
FIG. 18 illustrates an antenna array having super element subarrays, according to example implementations of the present disclosure.

FIG. 18 illustrates an antenna array having super element subarrays, according to example implementations of the present disclosure. In some implementations, multiple feed networks can feed different portions or sides of the aperture layer 406 to achieve multi-dimensional beam steering through phase shifting. For example, the super elements may be arranged into a subarray of super elements 430 within the super element layer 404. As illustrated in FIG. 18, sixteen (16) super elements 427 are configured within the antenna subarray 430. The boundary lines of the super elements 427 within the subarray of super elements 430 are defined by vias formed through the dielectric layer to couple the conductive layers. These define the transmission paths of the signals through the device. The illustrated example in FIG. 18 incorporates apertures 450 that correspond to positions with respect to the slots 422 of the super element layer 404. In these implementations, the super elements 427 are portions of the super elements 425. The super elements 427 may be similarly sized in some implementations; however, the super elements 427 may have different sizes and configurations in other implementations. The different sizing of the super elements 427 is used to provide tapering or beam-shaping refinements.

Figure 19:
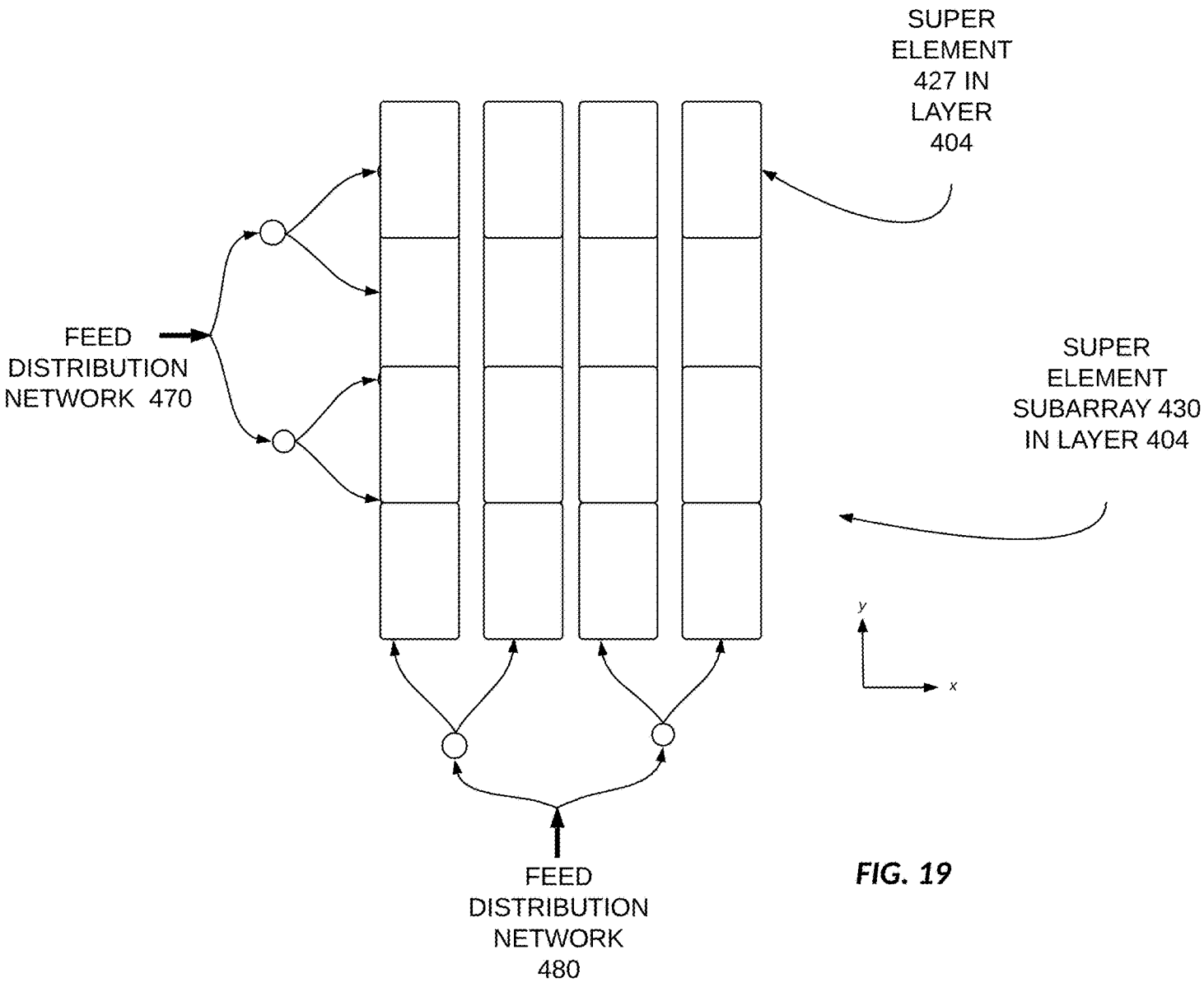
FIG. 19 conceptually illustrates orthogonal feed distribution networks coupled to a set of super element subarrays for orthogonal control of radiation patterns in multiple dimensions, according to some implementations of the subject technology.

FIG. 19 conceptually illustrates orthogonal feed distribution networks coupled to a set of super element subarrays (e.g., 430) for orthogonal control of radiation patterns in multiple dimensions, according to some implementations of the subject technology. As illustrated in FIG. 19, the set of super element subarrays (including super element subarray 430) are coupled to a feed distribution network 470 and a feed distribution network 480. In some aspects, the feed distribution network 470 is coupled directly to different super elements within a common super element subarray along the y-axis, whereas the feed distribution network 480 is coupled directly to different super element subarrays along the x-axis. In operation, the feed distribution network 470 feeds the super elements 427 from a first direction (e.g., x-direction) and the feed distribution network 480 feeds the super elements 427 (belong to different subarrays) from a second direction (e.g., y-direction) orthogonal to the first direction. In this way the transmission signal is provided to the super elements 427 from different directions resulting in signals radiating through apertures into multiple directions. In this respect, beam steering in multiple dimensions can be achieved.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

Furthermore, to the extent that the term "include," "have," or the like is used in the description or the claims, such term is intended to be inclusive in a manner similar to the term "comprise" as "comprise" is interpreted when employed as a transitional word in a claim.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

While this specification contains many specifics, these should not be construed as limitations on the scope of what may be claimed, but rather as descriptions of particular implementations of the subject matter. Certain features that are described in this specification in the context of separate embodiments can also be implemented in combination in a single embodiment. Conversely, various features that are described in the context of a single embodiment can also be implemented in multiple embodiments separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

The subject matter of this specification has been described in terms of particular aspects, but other aspects can be implemented and are within the scope of the following claims. For example, while operations are depicted in the drawings in a particular order, this should not be understood as requiring that such operations be performed in the particular order shown or in sequential order, or that all illustrated operations be performed, to achieve desirable results. The actions recited in the claims can be performed in a different order and still achieve desirable results. As one example, the processes depicted in the accompanying figures do not necessarily require the particular order shown, or sequential order, to achieve desirable results. Moreover, the separation of various system components in the aspects described above should not be understood as requiring such separation in all aspects, and it should be understood that the described program components and systems can generally be integrated together in a single hardware product or packaged into multiple hardware products. Other variations are within the scope of the following claim.

What is claimed is:

1. A radiating structure, comprising:

a distributed feed network comprising a plurality of paths and configured to propagate transmission signals through the plurality of paths;

an aperture structure comprising one or more aperture layers with apertures positioned in a specific orientation relative to a centerline of the one or more aperture layers and configured to propagate the transmission signals from the distributed feed network through the apertures;

a transmission array structure comprising a plurality of transmission lines coupled to the aperture structure and configured to propagate the transmission signals from the aperture structure through one or more slots in the transmission array structure, wherein the apertures of the aperture structure are interposed between the slots; and a radiating array structure coupled to the transmission array structure and configured to radiate the transmission signals from the transmission array structure, wherein the radiating array structure comprises at least one dielectric layer interposed between two conductive layers.

2. The radiating structure of claim 1, wherein each of the plurality of paths comprises a different number of transmission lines based at least on a number of division points in each of the plurality of paths.

3. The radiating structure of claim 1, wherein the distributed feed network comprises a power divider circuit configured to provide the transmission signals through the plurality of paths of the distributed feed network.

4. The radiating structure of claim 1, wherein the aperture structure comprises a substrate integrated waveguide (SIW), and wherein the transmission signals first propagate through the SIW of the aperture structure.

5. The radiating structure of claim 1, wherein the apertures are formed by slots in the one or more aperture layers, and wherein the transmission signals propagate through the slots on the transmission array structure and are radiated to the radiating array structure.

6. The radiating structure of claim 1, wherein the apertures are positioned within the one or more aperture layers to correlate to the slots on the layer of transmission lines along a length of the transmission lines.

7. The radiating structure of claim 1, wherein the transmission array structure is disposed proximate to the aperture structure along a first axis that is orthogonal to the length of the transmission lines, and wherein the radiating array structure is disposed proximate to the transmission array structure along the first axis.

8. The radiating structure of claim 1, wherein the apertures of the aperture structure are configured to reduce an amount of distortion in the transmission signals distributed through the aperture structure.

9. The radiating structure of claim 1, wherein the plurality of paths in the distributed feed network corresponds to dimensions of super elements on the transmission array structure, and wherein the apertures in the aperture structure are configured to feed signals to the super elements.

10. An antenna array structure, comprising:

an aperture layer comprising apertures positioned in a specific orientation relative to a centerline of the aperture layer and configured to propagate transmission signals through the apertures;

a super element layer comprising a plurality of transmission lines coupled to the aperture layer and configured to propagate the transmission signals from the aperture layer through one or more slots in the super element layer, wherein the one or more slots are arranged in a specific pattern to receive the transmission signals fed by the aperture layer; and a radiating layer coupled to the super element layer and configured to radiate the transmission signals from the super element layer, wherein one or more of the radiating layer, the super element layer, or the aperture layer has one dielectric layer interposed between two conductive layers.

11. The antenna array structure of claim 10, further comprising:

a first adhesive layer disposed on a top surface of the aperture layer, wherein the first adhesive layer is interposed between the aperture layer and the super element layer.

12. The antenna array structure of claim 11, wherein the top surface of the aperture layer is adhered to a bottom surface of the super element layer by the first adhesive layer.

13. The antenna array structure of claim 10, wherein the one or more of the radiating layer, the super element layer, or the aperture layer further comprises additional conductive layers.

14. The antenna array structure of claim 10, wherein the signals propagate through the aperture layer and the super element layer to the radiating layer, and wherein the signals propagate through the transmission lines of the aperture layer and radiate through apertures positioned within the plurality of transmission lines.

15. The antenna array structure of claim 10, further comprising:

a second aperture layer disposed proximate to the aperture layer and a second adhesive layer disposed on a top surface of the second aperture layer, wherein the second adhesive layer is interposed between the aperture layer and the second aperture layer, and wherein the top surface of the second aperture layer is adhered to a bottom surface of the aperture layer by the second adhesive layer.

16. The antenna array structure of claim 10, wherein the super element layer is interposed between and coupled to the aperture layer and the radiating layer.

17. The antenna array structure of claim 10, wherein the aperture layer comprises apertures arranged in a diagonal orientation relative to a centerline axis along a length of the aperture structure.

18. The antenna array structure of claim 10, wherein the apertures are arranged at an angle with respect to the centerline and are positioned between staggered slots along an axis orthogonal to the centerline.

19. The antenna array structure of claim 10, further comprising:

a feed distribution module coupled to the aperture layer and configured to provide signals to transmission lines formed in the aperture layer, wherein the feed distribution module comprises a first feed distribution network that is configured to feed a set of super element subarrays from a first direction and a second feed distribution network that is configured to feed the set of super element subarrays from a second direction orthogonal to the first direction.

20. The antenna array structure of claim 19, wherein the set of super element subarrays is coupled to the feed distribution module to radiate signals through the apertures at multiple directions through the aperture layer.

* * * * *